US011518670B2

(12) United States Patent
Kim et al.

(10) Patent No.: US 11,518,670 B2
(45) **Date of Patent: *Dec. 6, 2022**

(54) WATER PURIFIER AND METHOD FOR CONTROLLING THE SAME

(71) Applicant: LG ELECTRONICS INC., Seoul (KR)

(72) Inventors: Minho Kim, Seoul (KR); Youngseok Kim, Seoul (KR); Jongwon Yun, Seoul (KR); Hoon Jang, Seoul (KR); Jewook Jeon, Seoul (KR); Soonki Jung, Seoul (KR); Jingyu Ji, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/517,931

(22) Filed: Nov. 3, 2021

(65) Prior Publication Data

US 2022/0055884 A1 Feb. 24, 2022

Related U.S. Application Data

(63) Continuation of application No. 16/766,401, filed as application No. PCT/KR2019/000366 on Jan. 10, 2019, now Pat. No. 11,186,475.

(30) Foreign Application Priority Data

Jan. 11, 2018 (KR) ..... 10-2018-0004031

(51) Int. Cl.
*B67D 1/12* (2006.01)
*B67D 1/00* (2006.01)
*B67D 1/14* (2006.01)

(52) U.S. Cl.
CPC ..... *B67D 1/124* (2013.01); *B67D 1/0014* (2013.01); *B67D 1/0081* (2013.01);
(Continued)

(58) Field of Classification Search
CPC .... B67D 1/124; B67D 1/0014; B67D 1/0081; B67D 1/1405; B67D 2001/1483; B67D 2210/0001; B67D 2210/00065
See application file for complete search history.

(56) References Cited

U.S. PATENT DOCUMENTS 9,352,950 B2 5/2016 Berger
10,053,349 B2 8/2018 Yoon
(Continued)

FOREIGN PATENT DOCUMENTS

CN 101100318 1/2008
CN 102015055 A 4/2011
(Continued)

OTHER PUBLICATIONS

International Search Report dated Apr. 16, 2019 issued in Application No. PCT/KR2019/000366.
(Continued)

*Primary Examiner* — Timothy L Maust
(74) *Attorney, Agent, or Firm* — Ked & Associates, LLP

(57) ABSTRACT

Provided is a water purifier. The water purifier includes a water purifier body provided with a filter, purifying raw water supplied from the outside, and supplying purified water, a water discharge module of which at least a portion is coupled to protrude to the front of the water purifier body so that at least a portion thereof rotates or is elevated with respect to the water purifier body and which is provided with a water discharge nozzle, which supplies the purified water supplied from the water purifier body to a user, in a lower end thereof, a driving unit providing power providing power required for the rotation and elevation of the water discharge module, a detection unit installed in the water purifier body or the water discharge module to recognize a position and size of a container placed around the water purifier body, and a control unit receiving position information and size infor-
(Continued)

mation of the container from the detection unit to control the driving unit so that the water discharge nozzle moves above the container.

19 Claims, 14 Drawing Sheets

(52) U.S. Cl.
CPC ..... *B67D 1/1405* (2013.01); *B67D 2001/009* (2013.01); *B67D 2001/1483* (2013.01); *B67D 2210/0001* (2013.01); *B67D 2210/00065* (2013.01)

(56) References Cited

U.S. PATENT DOCUMENTS

| | | | | |
|---|---|---|---|---|
| 10,343,888 | B2 | 7/2019 | Jeon | |
| 10,465,977 | B2 | 11/2019 | Lee | |
| 10,611,623 | B2 | 4/2020 | Jeon | |
| 10,889,483 | B2 | 1/2021 | Jung | |
| 10,941,048 | B2 | 3/2021 | Moon | |
| 11,186,475 | B2 * | 11/2021 | Kim | B67D 1/0081 |
| 2015/0305548 | A1 | 10/2015 | Girault et al. | |
| 2017/0050836 | A1 | 2/2017 | Yoon | |
| 2017/0153056 | A1 | 6/2017 | Kim | |
| 2017/0291807 | A1 | 10/2017 | Jeon | |
| 2017/0319990 | A1 | 11/2017 | Jeon | |
| 2017/0320721 | A1 | 11/2017 | Choi | |
| 2017/0321927 | A1 | 11/2017 | Jeon | |
| 2018/0002153 | A1 | 1/2018 | Kim | |
| 2021/0024342 | A1 | 1/2021 | Kim | |

FOREIGN PATENT DOCUMENTS

| | | | |
|---|---|---|---|
| CN | 202287831 | | 7/2012 |
| CN | 106963241 | A | 7/2017 |
| CN | 107343755 | A | 11/2017 |
| CN | 107445217 | | 12/2017 |
| JP | 5220138 | | 6/2013 |
| KR | 10-2010-0054580 | | 5/2010 |
| KR | 10-1381803 | | 4/2014 |
| KR | 10-2015-0004669 | | 1/2015 |
| KR | 10-2017-0034847 | | 3/2017 |
| WO | WO 01/05484 | | 1/2001 |
| WO | WO 2009/131312 | A2 | 10/2009 |

OTHER PUBLICATIONS

U.S. Office Action dated Apr. 26, 2021 issued in parent U.S. Appl. No. 16/766,401.

Chinese Office Action dated Oct. 18, 2021 issued in Application 201980007652.2.

Extended European Search Report dated Aug. 26, 2021 issued in Application 19738470.4.

"Research on the Standard of Water Efficiency in Reverse Osmosis Drinking Water Treatment Purifiers;" Yu-jie Wang et al. Standard Science No. 1, 2017; pp. 63-66; Evaluation and Analysis on Standard; China Academic Journal Electronic Publishing House 1994-2021 (English Abstract).

PLC ( 和触摸屏在 纯净水生产 线控制系统 中的应用 ) Application of PLC and Touch Screen in Control System of Purified Water Production Line dated Jul. 15, 2012 (English Abstract attached).

Chinese Office Action dated Apr. 2, 2022 issued in Application No. 201980007662.2.

* cited by examiner

WATER PURIFIER AND METHOD FOR CONTROLLING THE SAME

CROSS-REFERENCE TO RELATED APPLICATIONS

This application is a Continuation Application of U.S. patent application Ser. No. 16/766,401 filed May 22, 2020, which is a U.S. National Stage Application under 35 U.S.C. § 371 of PCT Application No. PCT/KR2019/000366, filed Jan. 10, 2019, which claims priority to Korean Patent Application No. 10-2018-0004031, filed Jan. 11, 2018, whose entire disclosures are hereby incorporated by reference.

BACKGROUND

1. Field

The present disclosure relates to a purifier for water or other liquid and a method for controlling the same.

2. Background

In general, water purifiers are devices that filter water supplied from a water supply source by using physical and chemical methods to remove impurities and then supply the purified water.

Water purifiers may be classified into natural filtration-type water purifiers, direct filtration-type water purifiers, ion exchange resin-type water purifiers, distillation-type water purifiers, reverse osmotic pressure-type water purifiers, and the like according to purification principles or manners.

In addition, water purifiers store water purified while passing through a filter according to a configuration thereof. In general, water purifiers are mechanisms that remove impurities by filtering water and are widely used for home.

In case of household water purifiers, the water purifiers are connected to a water supply system to remove floating matters or harmful components, which are contained in tap water and purify as much water as desired by user's manipulation to dispense the purified water.

As described above, household water purifiers are being released in various products, which are capable of dispensing hot water and cold water as well as purified water. Also, in recent years, water purifiers capable of being installed in various installation environments with small sizes are being developed.

A water purifier in which a water outlet part for dispensing water is provided in an upper end of a main body unit, and the water outlet part is rotated at a set angle after being separated from the main body unit and is coupled again is disclosed in Korean Patent Registration No. 1381803. In the water purifier having the above-described structure, a user may separate and re-couples the water outlet part to change a position of the water outlet part to a set position in a state in which a position of a main body is maintained. Thus, the water purifier may be installed without being restricted by an installation space of the water purifier.

However, the water purifier according to the related art may have following limitations.

First, to change the position of the water outlet part, the water outlet part has to be separated from the main body unit and then be coupled again. Also, while the water outlet part is repeatedly separated and coupled, the coupling portion may be damaged.

Second, since a water discharge tube is connected to the water outlet part, when the water discharge tube is damaged while the water outlet part is separated, water leakage may occur. In addition, when the water outlet part is repeatedly rotated, the water discharge tube or a fitting part to which the water discharge tube is connected may be damaged to cause water leakage.

Third, the position of the water outlet part is determined by a recessed groove defined in the main body unit. Thus, the water outlet part may be disposed at only the set position in which the recessed groove is defined, but may not be disposed at any position.

Fourth, a container such as a cup may be disposed directly below a position at which the water outlet part is set, and in this state, water discharge may be performed.

Fifth, when the container such as the cup is disposed around the water purifier, since the water outlet part does not automatically rotate or descend, the user may directly match a position of the container to the position of the water outlet part.

BRIEF DESCRIPTION OF THE DRAWINGS

The embodiments will be described in detail with reference to the following drawings in which like reference numerals refer to like elements wherein.

DETAILED DESCRIPTION

Hereinafter, exemplary embodiments will be described in detail with reference to the accompanying drawings. The invention may, however, be embodied in many different forms and should not be construed as being limited to the embodiments set forth herein, and a person of ordinary skill in the art, who understands the spirit of the present invention, may readily implement other embodiments included within the scope of the same concept by adding, changing, deleting, and adding components; rather, it will be understood that they are also included within the scope of the present invention.

The drawings attached to the following embodiments are embodiments of the scope of the invention, but to facilitate understanding within the scope of the present invention, in the description of the fine portions, the drawings may be expressed differently according to the drawings, and the specific portions may not be displayed according to the drawings, or may be exaggerated according to the drawings.

Hereinafter, a water purifier according to an embodiment will be described in detail with reference to the accompanying drawings.

Figure 1:
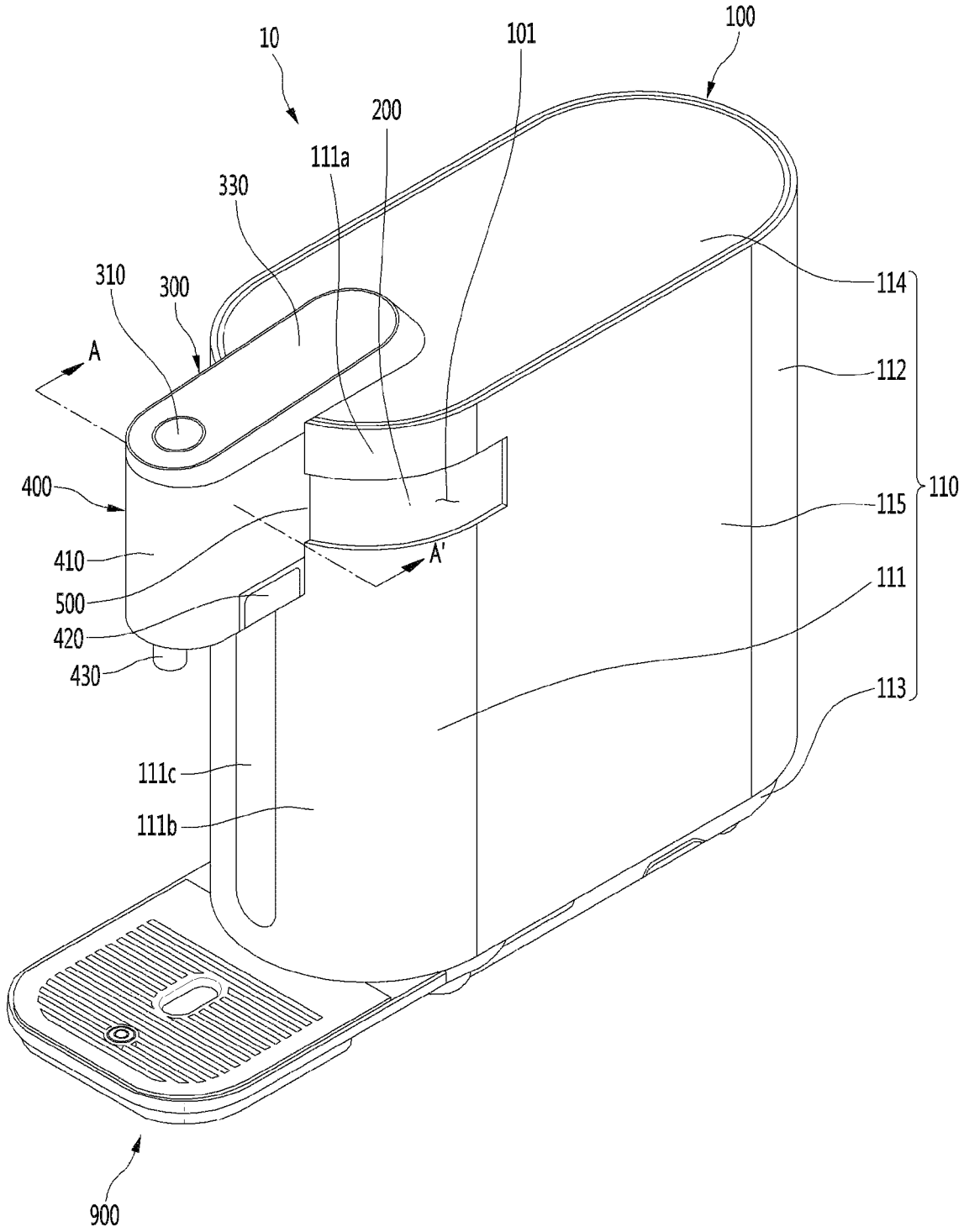
FIG. 1 is a perspective view of a water purifier according to an embodiment.

FIG. 1 is a perspective view of a water purifier according to an embodiment. Also, FIG. 2 is a perspective view illustrating a state in which a water discharge nozzle of the water purifier is changed in position according to an embodiment.

Figure 2:
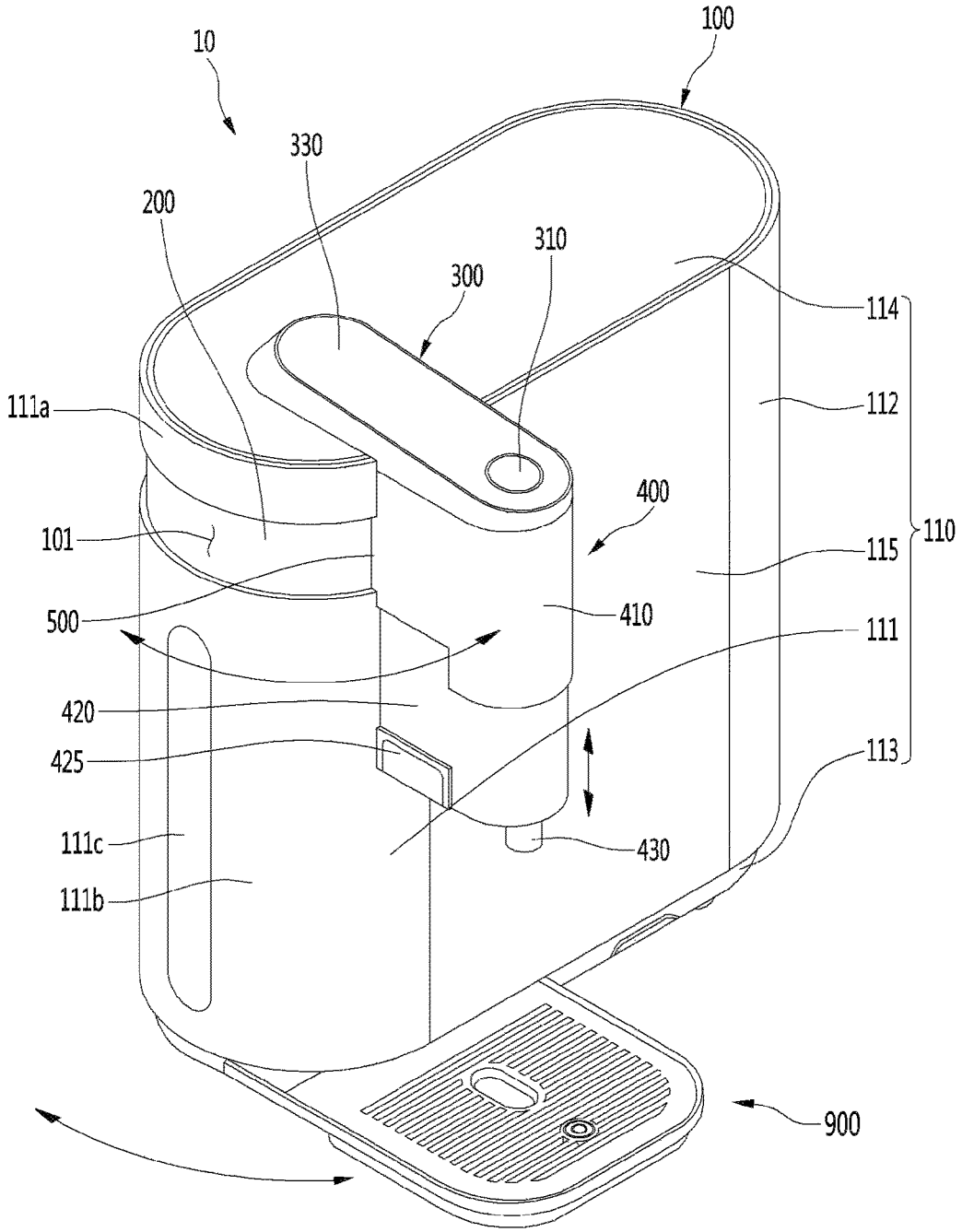
FIG. 2 is a perspective view illustrating a state in which a water discharge nozzle of the water purifier is changed in position according to an embodiment.

As illustrated in FIGS. 1 and 2, a water purifier (or liquid purifier) 10 according to an embodiment has a length that is long in a front and rear direction, and thus the water purifier 10 has a narrow width in a left and right direction. Thus, the water purifier 10 has a slim outer appearance on the whole.

Also, the water purifier 10 may include a water purifier body (or liquid purifier body) 100 and a water discharge module (or liquid discharge module) 400 installed at the front of the water purifier body 100 to horizontally rotate in both directions or operate to be vertically elevated with respect to the water purifier body 100 so as to change a position of a water discharge nozzle (or liquid discharge nozzle) 430.

First, the water purifier body 100 includes a housing 110 and a filter 120.

The outer appearance of the water purifier 10 may be defined by the housing 110. The housing 110 includes a front cover 111 defining an outer appearance of a front surface, a rear cover 112 defining an outer appearance of a rear surface, a base 113 defining a bottom surface, a top cover 114 defining a top surface, and side panels 115 defining both left and right surfaces. The front cover 111, the rear cover 112, the base 113, the top cover 114, and the pair of side panels 115 may be assembled with each other to constitute the outer appearance of the water purifier 10.

Here, each of front and rear ends of the base 113 and the top cover 114 may be rounded. Each of the front cover 111 and the rear cover 112 may protrude forward and backward to have a curvature corresponding to each of the front and rear ends of the base 113 and the top cover 114, which are rounded.

The filter 120 for purifying raw water or other liquid introduced from the outside to discharge the purified water is provided in the housing 110.

The water discharge module 400 is disposed on the front surface of the water purifier body 100. The water discharge module 400 may protrude forward from the front cover 111 to dispense the purified water through a water discharge nozzle 430 that protrudes downward.

Also, the front cover 111 may be constituted by an upper cover 111*a* and a lower cover 111*b*. The upper cover 111*a* and the lower cover 111*b* may be vertically spaced apart from each other. Also, an opening 101 may be defined between the upper cover 111*a* and the lower cover 111*b*. The opening 101 may be covered by a rotator 200 that is rotatably mounted on the water purifier body 100.

Here, a plane part 111*c* may be vertically provided at a central portion of the lower cover 111*b*.

As described above, when the plane part 111*c* is provided on the lower cover 111*b*, when compared with a case in which the whole lower cover 111*b* protrudes forward, a container such as a cup may be more deeply inserted when the user dispenses water, and also, the container such as the cup may be stably supported.

Also, when the water discharge module 400 rotates, a center may be centered with respect to the plane part 111*c*.

For reference, in a state in which the water discharge module 400 rotates in a left or right direction, the container such as the cup may be stably supported by a side panel 115 of a plane.

The water discharge module 400 rotates together with the rotator 200. Thus, the user may rotate the water discharge module 400 at a desired angle according to an installation state or installation environment of the water purifier 10.

For example, a manipulation part 300 including a water discharge button 310 may be disposed on the front of the top cover 114, and the manipulation part 300 may have a structure that is rotatable together with the water discharge module 400.

For another example, the manipulation part 300 may not be provided on the water purifier body 100 but be provided on the water discharge module 400.

In this case, the water discharge button 310 of the manipulation part 300 may be disposed on a top surface of the water discharge module 400. If the water discharge button 310 is disposed on the front surface of the water discharge module 400, when the user pushes the water discharge button 310, force in the horizontal direction may be applied to the water discharge module to allow the water discharge module 400 to be arbitrarily rotated. On the other hand, if the water discharge button 310 is disposed on the top surface of the water discharge module 400, when the user pushes the water discharge button 310, force in the vertical direction may be applied to the water discharge module to prevent the water discharge module 400 from being arbitrarily rotated. Thus, when the water discharge button 310 is provided on the water discharge module 400, the water discharge button 310 has to be provided on the top surface of the water discharge module 400.

For another example, the manipulation part 300 may be disposed on the top cover 114 of the water purifier body 100 and all both sides of the top surface of the water discharge module 400.

Also, the water discharge module 400 include an elevation unit which is fixed to the outside of the rotator 280 and by which the water discharge nozzle 430 varies in height. The water discharge nozzle 430 may vary in height due to the above-described elevation unit.

The above-described rotation and elevation operations of the water discharge module 400 will be described later.

Figure 3:
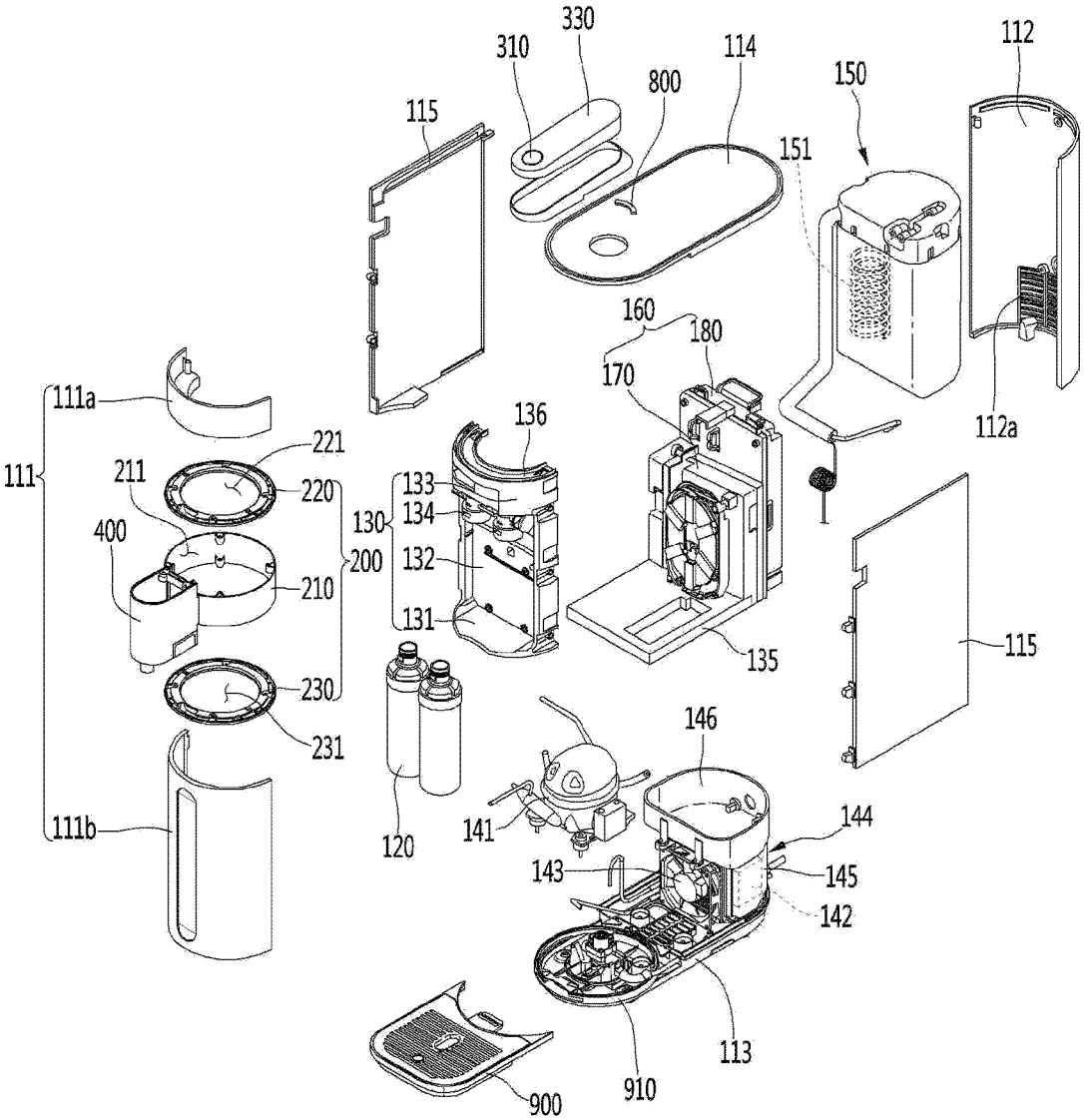
FIG. 3 is an exploded perspective view of the water purifier according to an embodiment.

FIG. 3 is an exploded perspective view of the water purifier according to an embodiment.

A filter 120 for purifying water and a filter bracket 130 on which a plurality of valves (not shown) are mounted may be provided in the housing 110.

The filter bracket 130 may include a bottom part (or bottom wall) 131 coupled to the base 113, a filter accommodation part (or filter accommodation wall) 132 in which the filter 120 is accommodated, and a rotator mounting part (or rotator mounting wall) 133 on which the rotator 200 is mounted.

In detail, the bottom part 131 may have a shape corresponding to that of the front end of the base 113 and be coupled to the base 113. The bottom part 131 may be coupled to fix a mounted position of the filter bracket 130 and define a shape of a bottom surface of the filter accommodation part 132.

The filter bracket 130 may be hooked to the base in a hook manner. Alternatively, the filter bracket 130 may be fixed by using a screw that is coupled to the bottom surface of the base 113.

The filter accommodation part 132 may extend in a vertical direction and define a space that is recessed backward (in a right direction in the drawing) from a front side (in a left direction in the drawing) to accommodate the filter 120. A plurality of filters 120 may be mounted on the filter accommodation part 132. The filters 120 may purify supplied raw water (tap water) and be constituted by combination of filters having various functions.

Also, a filter socket 134 on which the filter 120 is mounted may be further provided in the filter accommodation part 132. A tube through which the purified water flows may be provided in the filter socket 134 and connected to a plurality of valves (not shown). Thus, the raw water may sequentially pass through the filters 120 to flow to the valve (not shown) for supplying water.

The plurality of valves (not shown) may be provided in a rear surface (a right side in the drawing) of the filter accommodation part 132. The valves (not shown) may selectively supply purified water, cold water, and hot water to the filter 120, a cooling tank 150, an induction heating assembly 170, and the water discharge module 400.

The rotator mounting part 133 on which the rotator 200 is rotatably mounted is disposed on an upper end of the filter accommodation part 132.

Here, the rotator mounting part 133 may have a curvature corresponding to that of the front cover 111 that covers a front side of the rotator mounting part 133. An upper portion of the filter bracket 130 may be covered by the top cover 114. An upper end of the rotator mounting part 133 may extend backward, and a space in which the rotator 200 is mounted may be defined above the rotator mounting part 133.

Also, the manipulation part 300 may be provided above the rotator 200. The manipulation part 300 may be connected to the rotator 200 to rotate together with the rotator 200 when the rotator 200 rotates.

A compressor 141 and a condenser 142 are provided on the top surface of the base 113. Also, a cooling fan 143 is disposed between the compressor 141 and the condenser 142 to cool the compressor 141 and the condenser 142. An inverter-type compressor capable of adjusting cooling capacity by varying a frequency may be used as the compressor 141. Thus, the purified water may be efficiently cooled to reduce power consumption.

Also, the condenser 142 may be disposed at a rear side of the base 113 and also disposed at a position corresponding to a discharge hole 112*a* defined in the rear cover 112. The condenser 142 may have a structure in which a flat tube-type refrigerant tube is bent several times to efficiently use a space and improve heat-exchange efficiency and be accommodated in a condenser bracket 144.

A condenser mounting part 145 to which the condenser 142 is fixed and a tank mounting part 146 on which a cooling tank 150 for making cold water is mounted may be provided in the condenser bracket 144. The condenser mounting part 145 provides a space having a shape corresponding to the whole shape of the condenser 142 to accommodate the condenser 142. Also, the condenser mounting part 145 has portions that are opened and face the cooling fan 143 and the discharge hole 112*a* to effectively cool the condenser 142.

Also, the tank mounting part 146 is disposed on the condenser bracket 144, i.e., above the condenser mounting part 145. A lower end of the cooling tank 150 is inserted into the tank mounting part 146 to allow the tank mounting part 146 to fix the cooling tank 150.

The cooling tank 150 cools purified water to make cold water, and cooling water that is heat-exchanged with the introduced purified water is filled into the cooling tank 150. Also, an evaporator 151 for cooling the cooling water may be accommodated in the cooling tank 150. Also, the purified water may pass through the cooling tank 150 so as to be cooled.

A support plate 135 extending to the cooling tank 150 may be further provided at one side of the filter bracket 130. The support plate 135 may be disposed above the compressor 141 and extend from the filter bracket 130 up to the condenser bracket 144 to provide a space in which a heating and control module 160 is mounted.

The heating and control module 160 may include an induction heating assembly 160 for making hot water and a control assembly 180 for controlling an overall operation of the water purifier 10. The induction heating assembly 170 and the control assembly 180 may be coupled to each other to form one module and then be mounted on the support plate 135.

The induction heating assembly 170 may heat the purified water in an induction heating manner. The induction heating assembly 170 may immediately and quickly heat water when dispensing of hot water is manipulated and also may control an output of magnetic fields to heat the purified water at a desired temperature and thereby to provide the hot water to the user. Thus, hot water having a desired temperature may be dispensed according to the user's manipulation.

The control assembly 180 may control an operation of the water purifier 10. That is, the control assembly 180 may control the compressor 141, the cooling fan 143, various valves and sensors, and the induction heating assembly 170. The control assembly 180 may be provided as a module by combination of PCBs that are divided into a plurality of parts for each function. Also, in a structure for dispensing only cold water and purified water from the water purifier 10, a PCB for controlling the induction heating assembly 170 may be omitted, and also, at least one or more PCBs may be omitted in the above-described manner.

Hereinafter, main components of the water purifier will be described in more detail with reference to the accompanying drawings.

The water discharge module 400 includes the rotator 200 rotatably mounted on the water purifier body 100 to rotate in both directions with respect to the water purifier body 100 and the elevation unit fixed to the outside of the rotator 200 and allowing the water discharge nozzle 430 to vary in height.

Here, the elevation unit and the rotator 200 may be integrated with each other and also separably coupled to each other.

Figure 4:
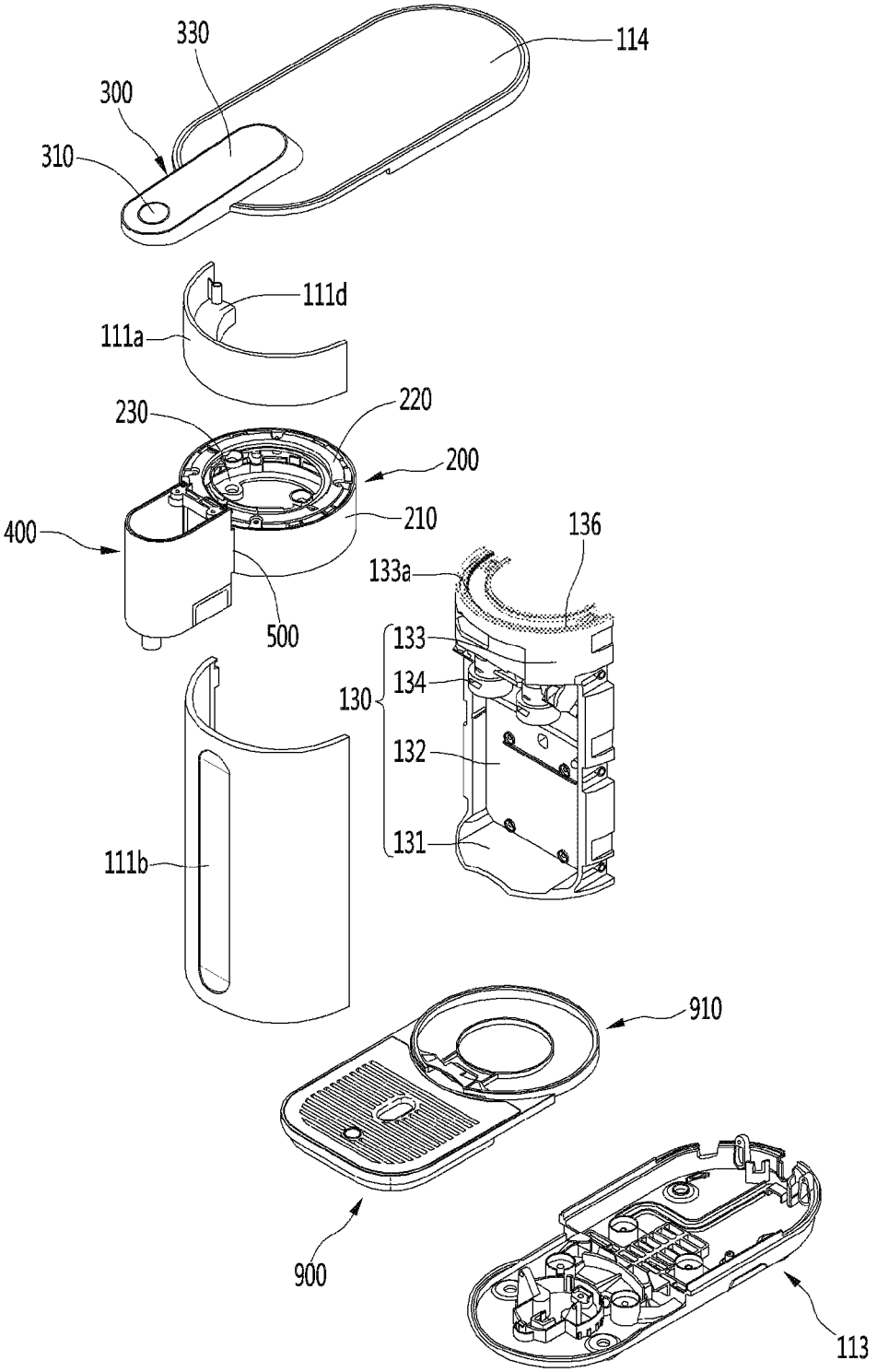
FIG. 4 is an exploded perspective view illustrating a portion of the water purifier of FIG. 3.

FIG. 4 is an exploded perspective view illustrating a portion of the water purifier of FIG. 3.

Figure 5:
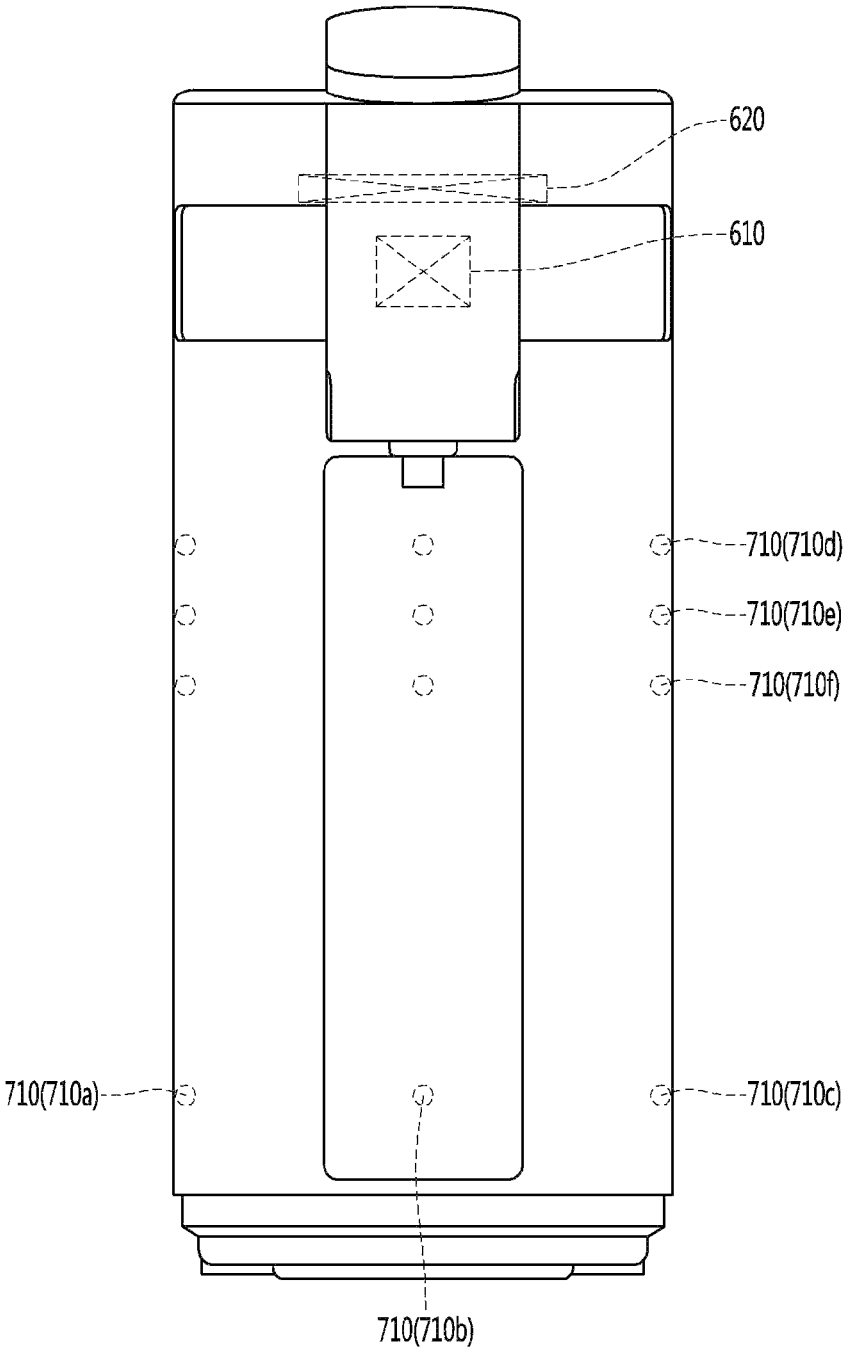
FIGS. 5 and 6 are front views illustrating a state in which a detection unit is provided in the water purifier according to an embodiment.
Figure 6:
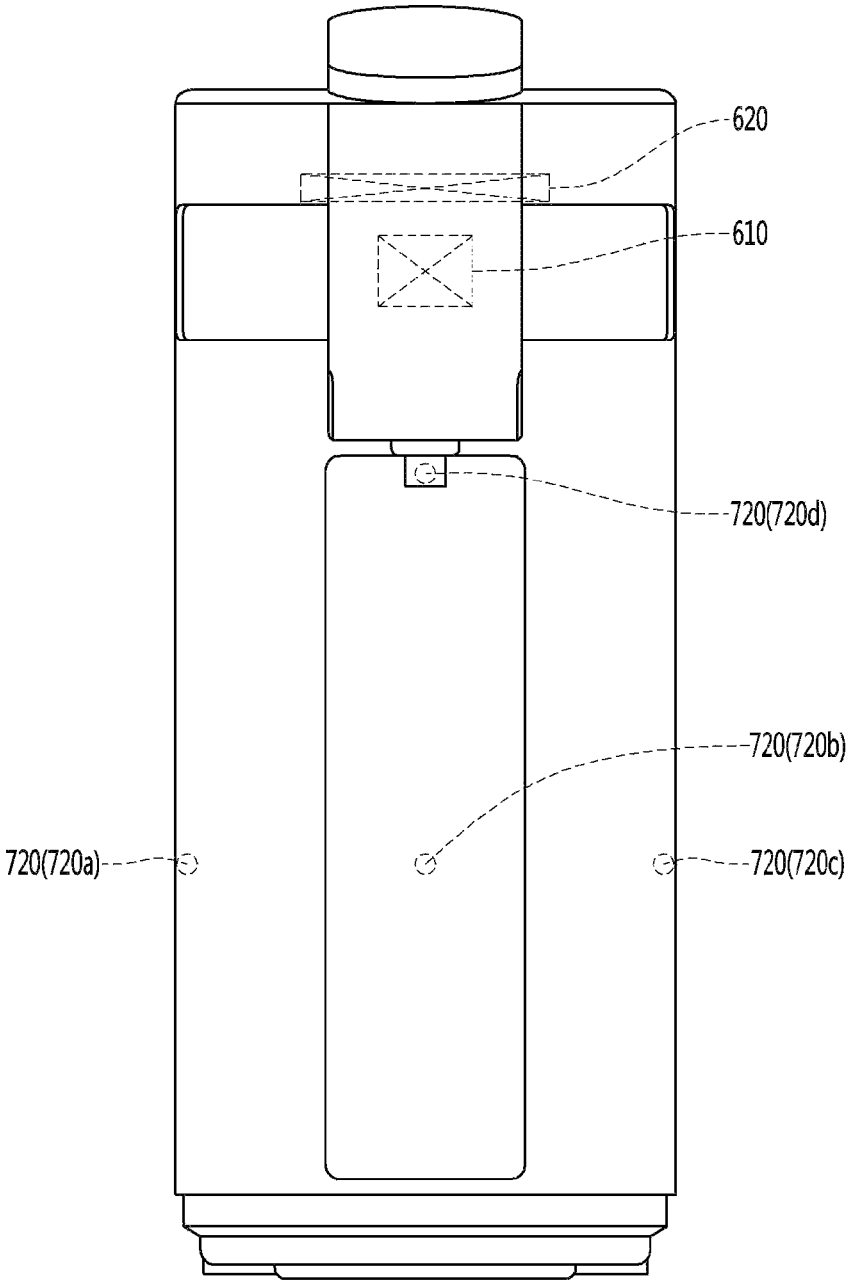

FIGS. 5 and 6 are front views illustrating a state in which a detection unit is provided in the water purifier according to an embodiment.

Referring to FIG. 4, the filter bracket 130 may include a bottom part 131 coupled to the base 113, a filter accommodation part 132 in which the filter 134 is accommodated, and a rotator mounting part 133 on which the rotator 200 is mounted.

In detail, the bottom part 131 may have a shape corresponding to that of the front end of the base 113 and be coupled to the base 113. The bottom part 131 may be coupled to fix a mounted position of the filter bracket 130 and define a shape of a bottom surface of the filter accommodation part 132.

The filter bracket 130 may be hooked to the base in a hook manner. Alternatively, the filter bracket 130 may be fixed by using a screw that is coupled to the bottom surface of the base 113. The bottom part 131 does not interfere with a rotation ring 910 rotatably fixed to the base 113 so that a tray 900 rotates. Thus, the tray 900 may smoothly rotate.

Also, the filter 120 is mounted on the filter accommodation part 132.

The rotator mounting part 133 is disposed on an upper end of the filter accommodation part 132. The rotator mounting part 133 has a predetermined curvature and a semicircular shape protruding forward. Also, the rotator mounting part 133 has a structure in which the rotator 200 is seated on an upper end thereof. Here, the rotator mounting part 133 may have a curvature corresponding to an outer surface of the rotator 200. Thus, the rotator 200 may rotate in the state of being seated on the rotator mounting part 133.

Also, a protrusion protruding upward in parallel to a circumference may be disposed on an extension part 136 extending backward from an upper end of the rotator mounting part 133, and an internal gear 133*b* may be disposed on an inner surface of the protrusion. The internal gear 133*b* has a curvature corresponding the rotator mounting part 133 and is gear-coupled to a pinion gear 271, which will be described below, that rotatably mounted on a lower end of the rotator 200. Thus, the pinion gear 271 rotates along the internal gear 133*b*, and the rotator 200 rotates.

The rotator 200 has a circular shape, and the water discharge module 400 protrudes forward from the rotator 200. The water discharge module 400 may be integrated with the rotator 200. Here, when the rotator 200 rotates, the water discharge module 400 may rotate together with the rotator 200.

The upper cover 111*a* may be disposed above the rotator 200. The upper cover 111*a* may define an outer appearance of the front surface of the water purifier 10 together with the lower cover 111*b* covering a front side of the filter bracket 130. Thus, the upper cover 111*a* may define a portion of the outer appearance of the front surface of the water purifier between the rotator 200 and the top cover 114 and be rounded.

The top cover 114 may be disposed on the upper end of the upper cover 111*a*. The top cover 114 defines a top surface of the water purifier 10. Also, the manipulation part 300 is mounted on the top cover 114. The manipulation part 300 may have a circular shape and be coupled to the rotator 200 to rotate together with the rotator 200 when the rotator 200 rotates. Also, the water discharge button 310 is disposed on the manipulation part 300.

In this embodiment, a portion of the manipulation part 300 covers a top surface of the water discharge module 400, and the rest portion is coupled to the top cover 114. The manipulation part 300 may have an oval shape. Also, the top surface of the manipulation part 300 may have an inclined surface that is inclined downward toward a side that is close to the water discharge module 400.

Thus, the manipulation of the manipulation part 300 may be improved, and, the user's operation convenience and recognition may be improved.

Referring to FIGS. 5 and 6, the water purifier according to an embodiment may include driving units (or driving motors) 610 and 620 providing power required for an rotation operation or an elevation operation of the water discharge module 400, detection units (or sensors) 710 and 720 installed on the water purifier body 100 or the water discharge module 400 to detect a position and a size of the container placed around the water purifier body 100, and a control unit (or controller) receiving the position and size information of the container from the detection units 710 and 720 to control the driving units 610 and 620 so that the water discharge nozzle 430 moves to an upper side of the container.

For example, the detection unit 710 or 720 may include a proximity sensor 710 or a camera 720. Hereinafter, the proximity sensor 710 and the camera 720 may mean the detection units 710 and 720.

The detection units 710 and 720 may be provided in plurality in a longitudinal direction (in an elevation direction of the elevation cover) on the front cover 111 covering the front surface of the water purifier body 100 or the side panel 115 defining a side surface of the water purifier body 100.

Also, the detection units 710 and 720 may be provided in plurality in a transverse direction (in a rotation direction of the rotator) on the front cover 111 covering the front surface of the water purifier body 100 or the side panel 115 defining a side surface of the water purifier body 100.

For example, the front cover 111 may have a shape that protrudes forward, and the detection units 710 and 720 may be disposed to be spaced apart from each other in a circumferential direction of the front cover 111.

For another example, the detection units 710 and 720 may be installed on a lower end of the water discharge module 400 or the water discharge nozzle 430.

The detection units 710 and 720 detect a position and height of the container such as the cup placed around the front cover 111.

For example, the detect units 710 and 720 detect whether the container such as the cup is placed at a center of the front cover 111 or placed at a left or right side from a center.

For this, the detection units 710 and 720 may be disposed to be spaced apart from each other along the circumference of the front cover 111 at a lower portion or central portion of the front cover 111 to detect a transverse position of the container placed around the front cover 111.

Referring to FIGS. 5 and 6, the detection units 710 and 720 may be installed at the center of the front cover 111 to detect the container placed at the center of the front cover 111. Also, the detection units 710 and 720 may be installed at the left side from the center of the front cover 111 to detect the container placed at the left side from the center of the front cover 111. Also, the detection units 710 and 720 may be installed at the right side from the center of the front cover 111 to detect the container placed at the right side from the center of the front cover 111.

In addition, the detection units 710 and 720 may detect the Hight of the container placed around the front cover 111.

For example, referring to FIG. 5, the detection unit 710 may be provided as the proximity sensor. The detection unit 710 may be provided in plurality to detect the height of the container placed around the front cover 111 and be vertically spaced apart from each other.

For another example, referring to FIG. 6, the detection unit 720 may be provided as the camera. The detection unit 720 may be installed on the central portion of the front cover 111 or the lower end of the water discharge module 400 to detect the height of the container placed on the front cover 111 on the basis of obtained focus information or image information.

Figure 7:
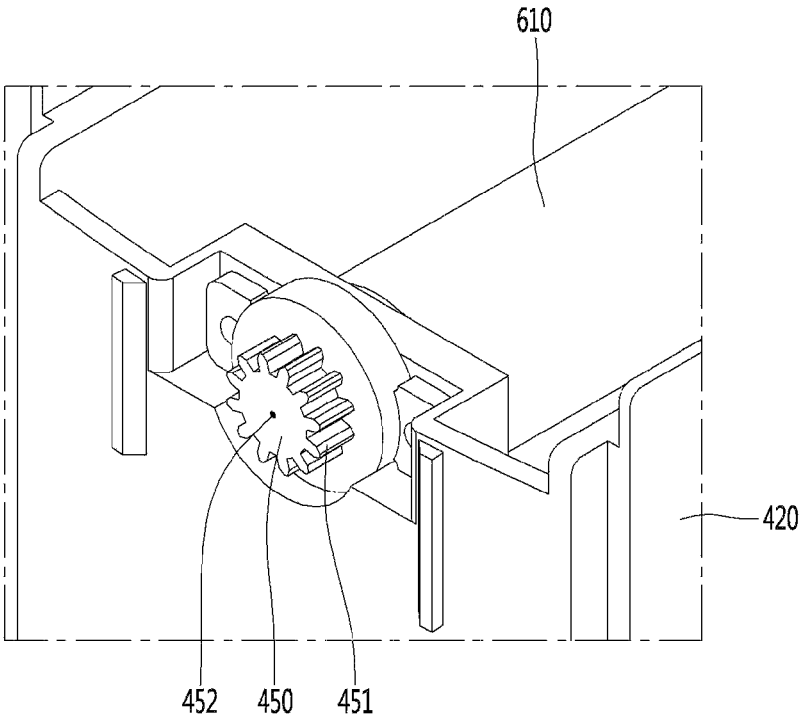
FIG. 7 is a perspective view illustrating a portion of an elevation cover.
Figure 8:
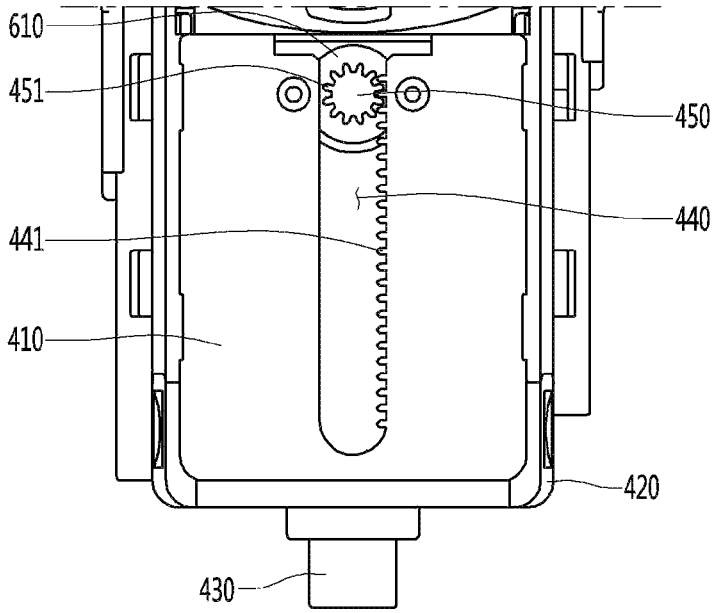
FIG. 8 is a front view of a water discharge module in a state in which the elevation cover ascends.

FIG. 7 is a perspective view illustrating a portion of the elevation cover. Also, FIG. 8 is a front view of the water discharge module in a state in which the elevation cover ascends. Also, FIG. 9 is a front view of the water discharge module in a state in which the elevation cover descends.

Figure 9:
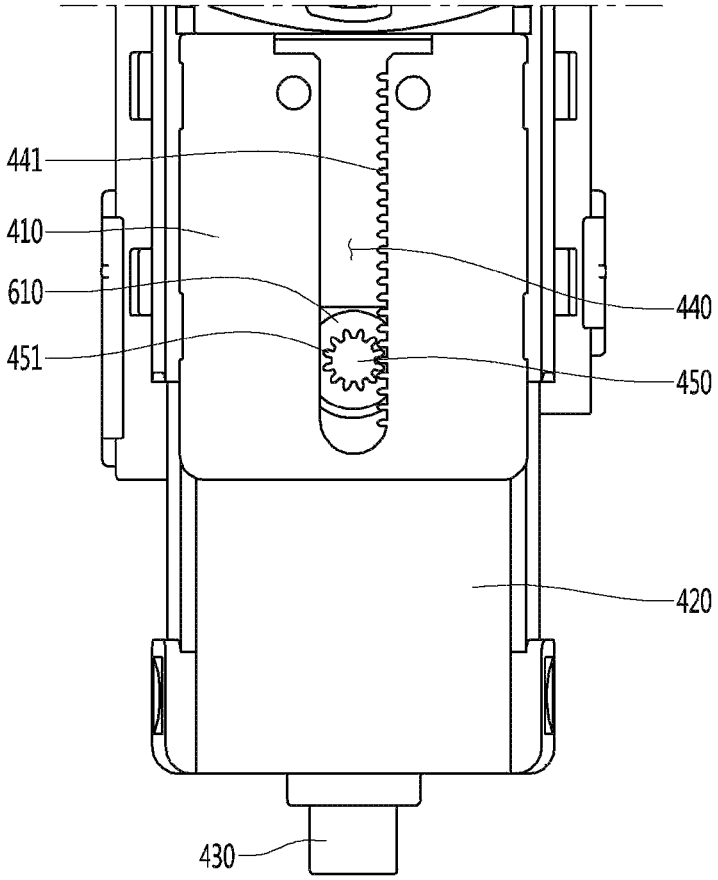
FIG. 9 is a front view of the water discharge module in a state in which the elevation cover descends.

Referring to FIGS. 7 to 9, the water discharge module 400 may include a fixed cover 410 fixed to the rotator 200 disposed inside the water purifier body 100 through the opening 101 defined in the front cover 111, protruding forward from the water purifier body 100, and having an upper end connected to a lower end of the manipulation part 300, an elevation cover 420 accommodated in the fixed cover 410 and elevated while being supported to contact the fixed cover 410, and a water discharge nozzle 430 mounted on a lower end of the elevation cover 420 to be elevated together with the elevation cover 420.

The water discharge nozzle 430 may be coupled to the lower end of the elevation cover 420. When the elevation cover 420 is elevated along the fixed cover 410, a position (height) of the water discharge nozzle 420 in the vertical direction may vary.

Although described below, since the fixed cover 410 is fixed to the rotator 200, the elevation cover 420 and the water discharge nozzle 430, which are elevatably coupled to the fixed cover 410, may vary in position in the horizontal direction.

For reference, an upper end of the fixed cover 410 is connected to a lower end of the manipulation part 300.

Thus, a gap may be defined between the rotator 200 and the manipulation part 300. When the elevation cover 420 maximally ascends, the upper end of the elevation cover 420 may be disposed in the gap between the rotator 200 and the manipulation part 300.

When the elevation cover 420 ascends, the elevation cover may increase in length. Thus, a maximum ascending height of the elevation cover 420 and the water discharge nozzle 430 coupled to the elevation cover 420 may increase. Also, the maximum descending height of the elevation cover 420 and the water discharge nozzle 430 coupled to the elevation cover 420 may be more lowered.

That is, a height adjustment range of the elevation cover 420 and the water discharge nozzle 430 coupled to the elevation cover 420 may increase.

Also, when the upper end of the fixed cover 410 is connected to the lower end of the manipulation part 300 as described above, the upper end of the water discharge module 400 may be primarily supported on the water purifier body 100 by the manipulation part 300, and then the lower end or central portion of the water discharge module 400 may be secondarily supported on the water purifier body 100 by the rotator 200.

Thus, the water discharge module 400 may be more firmly connected to the water purifier body 100. When the water discharge module 400 rotates or operates to be elevated, the water discharge module 400 may be prevented from being shaken.

In this embodiment, the rotator 200 and the water discharge module 400 may be connected to each other by a bridge 500 passing through the opening 101.

The bridge 500 may integrally connect the rotator 200 to the fixed cover 410.

The bridge 500 passes through the opening 101 and has both ends that are respectively fixed to the rotator 200 and the fixed cover 410.

Thus, when the water discharge module 400 and the rotator 200 rotate, the bridge 500 may move along the opening 101.

In this embodiment, passages communicating with each other so that various tubes pass the passages may be provided in the bridge 500, the front end of the rotator 200 to which the bridge 500 is connected, and the rear surface (the right side in FIG. 4) of the elevation cover 420. When the passages are provided as described above, the inner space of the water purifier body 100 and the inner space of the elevation cover may communicate with each other.

Thus, a tube for supplying at least one of purified water, cold water, and hot water to the water purifier body 100 may be connected to the water discharge nozzle 430, which is provided in the elevation cover 420, through the passages.

For example, the tube may include a purified water tube for supplying the purified water and the cold water and a hot water tube for supplying the hot water.

Here, each of the purified water tube and the hot water tube may be made of a flexible material such as rubber and silicon and thus be bent or spread to correspond to the elevation operation of the elevation cover 420.

In this case, when the elevation cover 420 and the water discharge nozzle 430 are elevated, the tube may be bent or spread into the inner space of the elevation cover 420 to correspond to the elevation operation of the elevation cover 420. Furthermore, the cold water, the purified water, and the hot water may be supplied to the water discharge nozzle 430 regardless of the height of the elevation cover 420 and the water discharge nozzle 430.

The fixed cover 410 may has an elevation space therein in the vertical direction. The elevation cover 420 may be accommodated in the elevation space defined in the fixed cover 410 and then be elevated so that the water discharge nozzle 430 varies in height.

That is, the elevation cover 420 may be elevated while being inserted or withdrawn to the opened lower side of the fixed cover 410 in the state of being accommodated in the fixed cover 410.

For example, when the elevation cover 420 maximally ascends, the elevation cover 420 may be completely accommodated into the fixed cover 410.

As described above, in the state in which the elevation cover 420 ascends, when the elevation cover 420 descends, the elevation cover 420 is exposed to the outside of the fixed cover 410.

On the other hand, in the state in which the elevation cover 420 descends, when the elevation cover 420 ascends, the elevation cover 420 is accommodated into the fixed cover 410.

In this manner, the elevation cover 420 may be elevated, and thus, the water discharge nozzle 430 fixed to the elevation cover 420 may vary in height.

For reference, the elevation cover 420 may have an outer appearance corresponding to that of the elevation space of the fixed cover 410.

For example, at least a portion of each of the fixed cover 410 and the elevation cover 420 may have an arc-shaped cross-section or a circular cross-section.

For another example, at least a portion of each of the fixed cover 410 and the elevation cover 420 may have a straight line-shaped cross-section. Respectively, each of the fixed cover 410 and the elevation cover 420 may have various cross-sections.

Also, the water discharge module 400 may include (or guide) 440 and 450 that secure fixing force between the fixed cover 410 and the elevation cover 420 and linearly guiding the elevation of the elevation cover 420.

Since the elevation cover 420 is elevated in the state of being accommodated in the fixed cover 410, the elevation cover 420 may be linearly elevated by the fixed cover 410. However, when the elevation cover 420 is exposed to the outside of the fixed cover 410 and thus is slightly shaken to both sides, the elevation operation of the elevation cover 420 may be instable. If this phenomenon is repeated, the fixed cover 410 or the elevation cover 420 may be deformed or damaged.

For example, the fixed cover 410 and the elevation cover 420 may have a protrusion part and a groove part at positions corresponding to each other in the elevation direction of the elevation cover 420, respectively. Thus, the linear movement of the elevation cover 420 may be guided while the coupling force between the fixed cover 410 and the elevation cover 420 increases.

Here, when the groove part is defined in the fixed cover 410, the protrusion part inserted into the groove part may be provided on the elevation cover 420.

On the other hand, when the protrusion part is provided on the fixed cover 410, the groove part into which the protrusion part is inserted may be provided in the elevation cover 420.

Referring to FIGS. 7 to 9, the guide parts 440 and 450 may include a guide groove 440 recessed downward from an upper side in the elevation direction of the fixed cover 410 and having gear teeth 431 on at least one side of an inner surface thereof and a first pinion gear 450 rotatably coupled to an upper end of a front surface of the elevation cover 420 facing the guide groove 440 and inserted into the guide groove 440 so as to be engaged with the gear teeth 441 to rotate and be elevated.

On the other hand, the guide parts 440 and 450 may include a guide groove that is defined in the elevation direction of the elevation cover 420 and having gear teeth on an inner surface thereof and a first pinion gear rotatably coupled to the fixed cover 410 and inserted into the guide groove so as to be engaged with the gear teeth.

The first pinion gear 450 may be inserted into the guide groove that is linearly defined and thus linearly move along the guide groove 440. Thus, the elevation cover 420 may be linearly elevated.

Also, the first pinion gear 450 may be rotatably mounted by the elevation cover 420.

The first pinion gear 450 may be engaged with the gear teeth 441 of the guide groove 440 in a rack and pinion manner. While the first pinion gear 450 rotates, the first pinion gear 450 may be linearly elevated along the guide groove 440.

As described above, due to the first pinion gear 450 and the guide groove 440 having the gear teeth 441, the first pinion gear 450 may be more accurately elevated along the guide groove 440 while rotating. Thus, the elevation of the elevation cover 420 may be more accurately linearly performed.

Also, each of the gear teeth 441 of the guide groove 440 and the gear teeth 451 of the first pinion gear 450 may have a linear section or a curved section that is perpendicular to or inclined in the elevation direction of the elevation cover 220. Particularly, a portion or the whole of each of the gear teeth 441 of the guide groove 440 and the gear teeth 451 of the first pinion gear 450 may be curved.

As described above, when each of the gear teeth 441 of the guide groove 440 and the gear teeth 451 of the first pinion gear 450 is curved, the gear teeth 441 of the guide groove 440 and the gear teeth 451 of the first pinion gear 450 may be smoothly engaged with each other. Also, while the elevation cover 220 is elevated, the gear teeth 441 of the guide groove 440 and the gear teeth 451 of the first pinion gear 450 may be prevented from being damaged by force applied to the gear teeth 441 of the guide groove 440 and the gear teeth 451 of the first pinion gear 450.

If each of the first gear teeth 441 of the guide groove 440 and the second gear teeth 451 of the first pinion gear 450 is curved and has a sharp edge, the force may be concentrated into the sharp portion to damage the sharp portion.

For example, an uneven portion of each of the gear teeth 441 of the guide groove 440 and the gear teeth 451 of the first pinion gear 450 may protrude or be recessed in a semicircular shape.

Referring again FIGS. 7 to 9, a first rotation shaft 452 of the first pinion gear 450 is connected to a first driving member 610 providing rotation power. Here, the first driving member 610 may mean the driving unit that is described above.

Thus, when the first driving member 610 rotates, the first pinion gear 450 may also rotate.

Here, the control unit may change the rotation direction of the first driving member 610 to elevate the elevation cover 520.

Also, the control unit may change the rotation rate of the first driving member 610 to adjust a rotation rate of the elevation cover 520.

For example, the first driving member 610 may be provided as a motor that is rotatable in both directions.

Thus, when a signal is outputted from the control unit to the first driving member 610, the first driving member 610 may rotate. Thus, the first pinion gear 450 may be elevated along the guide grove 440 in the first rotation direction, and the elevation cover 420 to which the first pinion gear 450 is fixed and the water discharge nozzle 430 may be elevated.

Here, the control unit may be connected to the detection units 710 and 720 to adjust the rotation and the rotation rate of the first driving member 610 according to the height of the container detected by the detection units 710 and 720.

As described above, a specific method for controlling the first driving member through the detection unit and the control unit will be described later.

Figure 10:
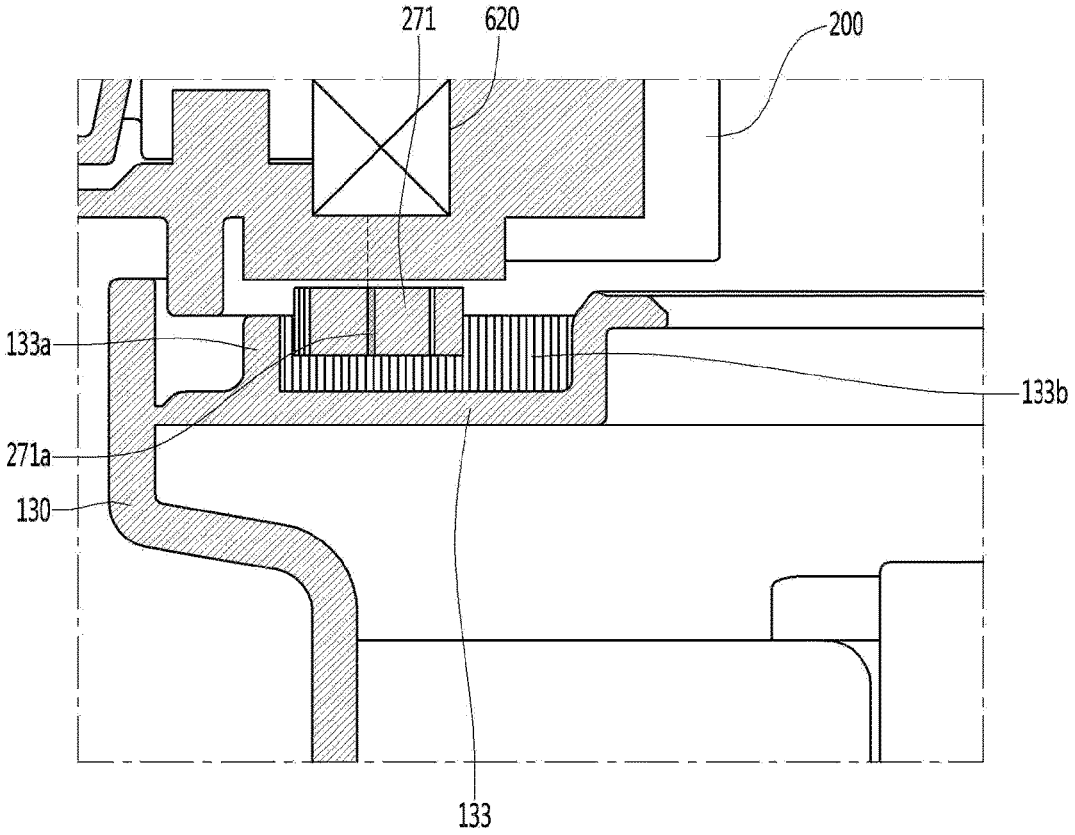
FIG. 10 is a longitudinal cross-sectional view illustrating a coupling structure of a rotator and a filter bracket.
Figure 11:
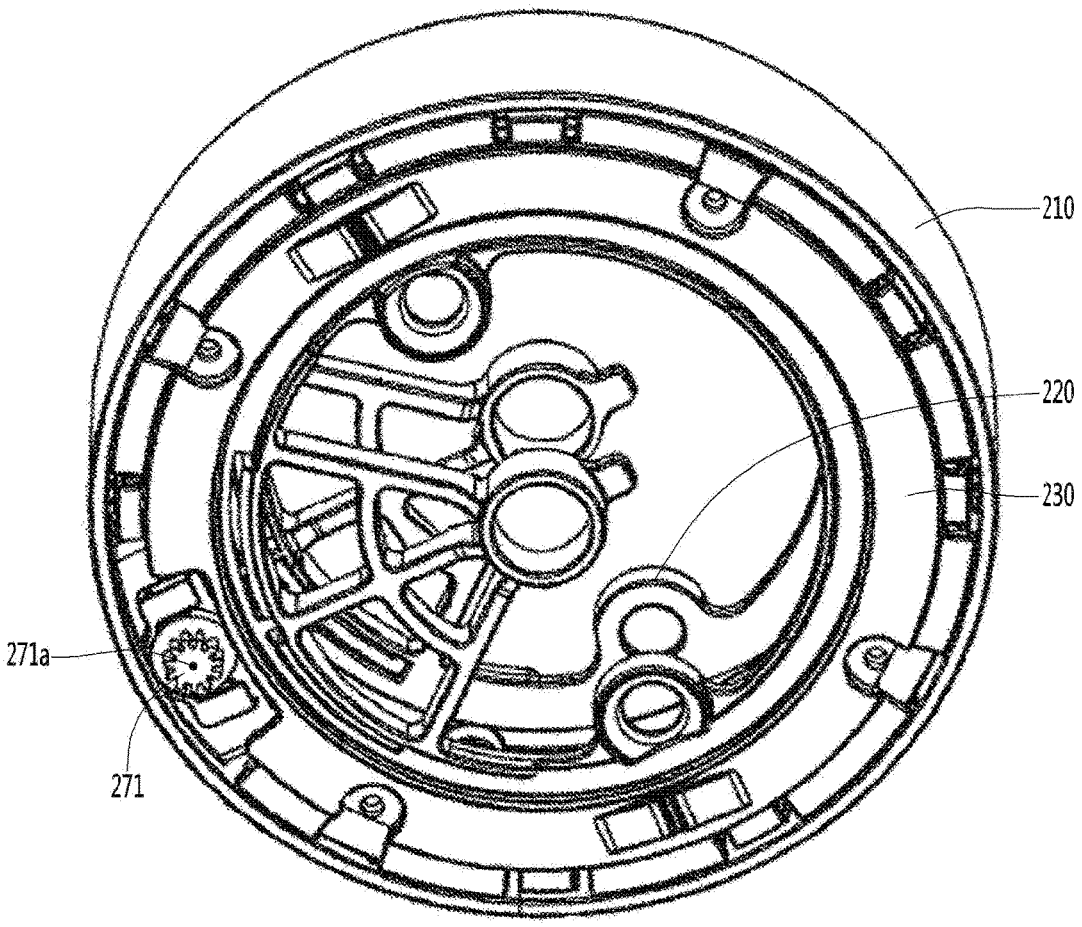
FIG. 11 is a bottom perspective view of the rotator.
Figure 12:
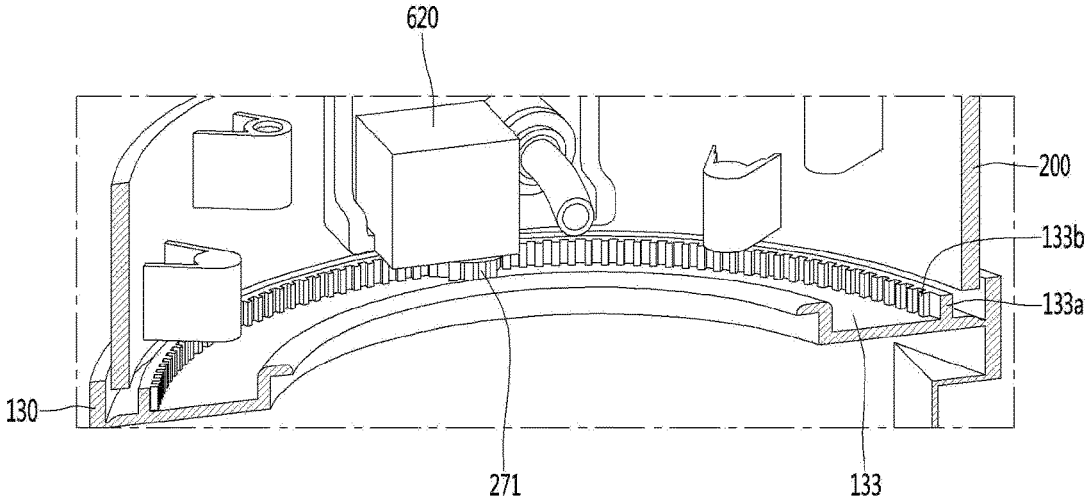
FIG. 12 is a rear perspective view illustrating a coupling structure of the rotator and the filter bracket.

FIG. 10 is a longitudinal cross-sectional view illustrating a coupling structure of the rotator and the filter bracket. Also, FIG. 11 is a bottom perspective view of the rotator. Also, FIG. 12 is a rear perspective view illustrating a coupling structure of the rotator and the filter bracket.

Hereinafter, the 'rotator' that is a component according to an embodiment will be described.

The water discharge module 400 may be connected to the rotator 200 to allow the water discharge nozzle 430 to vary in the horizontal position while rotating together with the rotator 200.

Referring to FIGS. 3 and 11, the rotator 200 may include a circular rotator body 210 having a hollow 211, an upper disk 220 fixed to an upper portion of the rotator body 210, and a lower disk 230 fixed to a lower portion of the rotator body 210.

The rotator body 210, the upper disk 220, and the lower disk 230 may be coupled to each other through assembly to form one module.

For example, the rotator body 210 may include a plurality of first seating protrusions, on which a lower end of the upper disk 220 is seated, in an upper portion of the inside thereof and a plurality of second seating protrusions, on which an upper end of the lower disk 230 is seated, in a lower portion of the inside thereof.

Also, the first seating protrusions and the upper disk and the second seating protrusions and the lower disk may be integrally coupled to each other through a coupling unit such as a screw.

Also, through-holes 221 and 231 communicating with the hollow of the rotator body 210 may be defined in central portions of the upper disk 220 and the lower disk 230, respectively.

The through-holes 221 and 231 may be coaxially disposed with the rotation center of the rotator 200.

The through-holes 221 and 231 may be defined to inform the installation positions of the purified water tube and the hot water tube, through which the water to be dispensed flows, to the worker.

For example, the hot water tube, the purified water tube, and the cold water tube may be inserted into the rotator 200 through the through-holes 221 and 231.

The rotator 200 may be rotatably mounted in the water purifier body 100.

Here, a second opinion gear 271 is rotatably mounted on a lower end of the inside of the rotator 200, and a protrusion 133*a* protruding upward along the circumferential direction is disposed on the rotator mounting part 133. Also, an internal gear 133*b* is disposed on an inner surface of the protrusion 133*a*. When viewed from the upper side, the protrusion 133*a* may have a semicircular shape or an arch shape.

Thus, when the rotator 200 rotates, the second pinion gear 271 moves along the internal gear 133*b*.

Also, a second rotation shaft 271*a* of the second pinion gear 271 is connected to a shaft of a second driving member 620 protruding rotation power. The second driving member 620 may mean the driving unit.

Also, the rotation direction of the second driving member 620 may be changed to allow the rotator 200 to rotate in both directions.

For example, the second driving member 620 may be provided as a motor that is rotatable in both directions.

Thus, when a signal is outputted from the control unit to the second driving member 620, the second driving member 620 rotates, and the second pinion gear 271 and the internal gear 133*b* rotate in the rotation direction. Also, while the second pinion gear 271 rotates to one side or the other side, the second pinion gear 271 moves in both directions along the rotator 200 to which the second pinion gear 271 is fixed. In this process, the rotator 200 and the water discharge module 400 connected to the rotator 200 may rotate.

Here, the control unit may be connected to the detection units 710 and 720 to adjust the rotation and the rotation rate of the second driving member 620 according to the position of the container detected by the detection units 710 and 720.

As described above, a specific method for controlling the second driving member 620 through the detection unit and the control unit will be described later.

Figure 13:
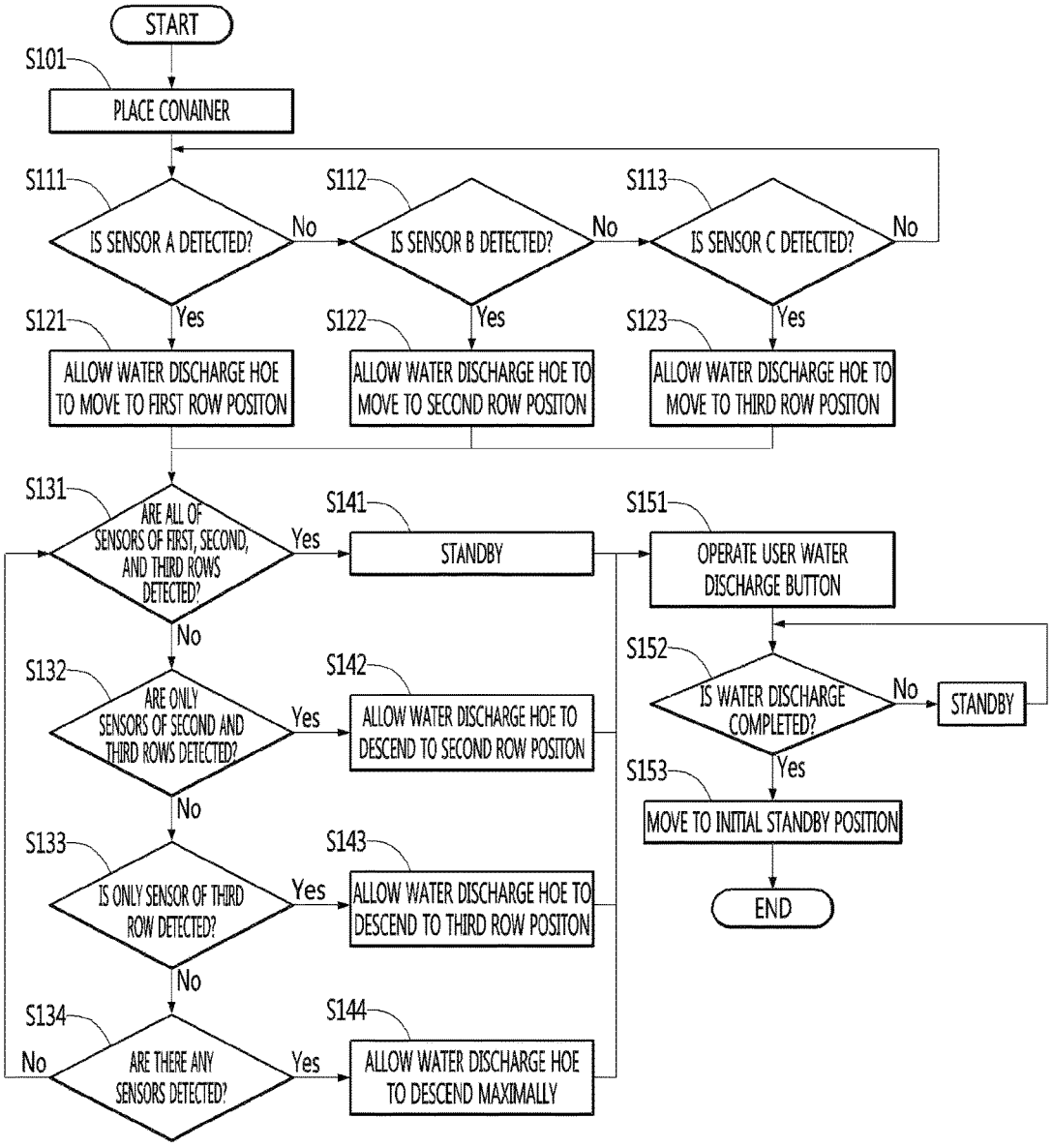
FIG. 13 is a flowchart illustrating a method for controlling a water purifier according to an embodiment.
Figure 14:
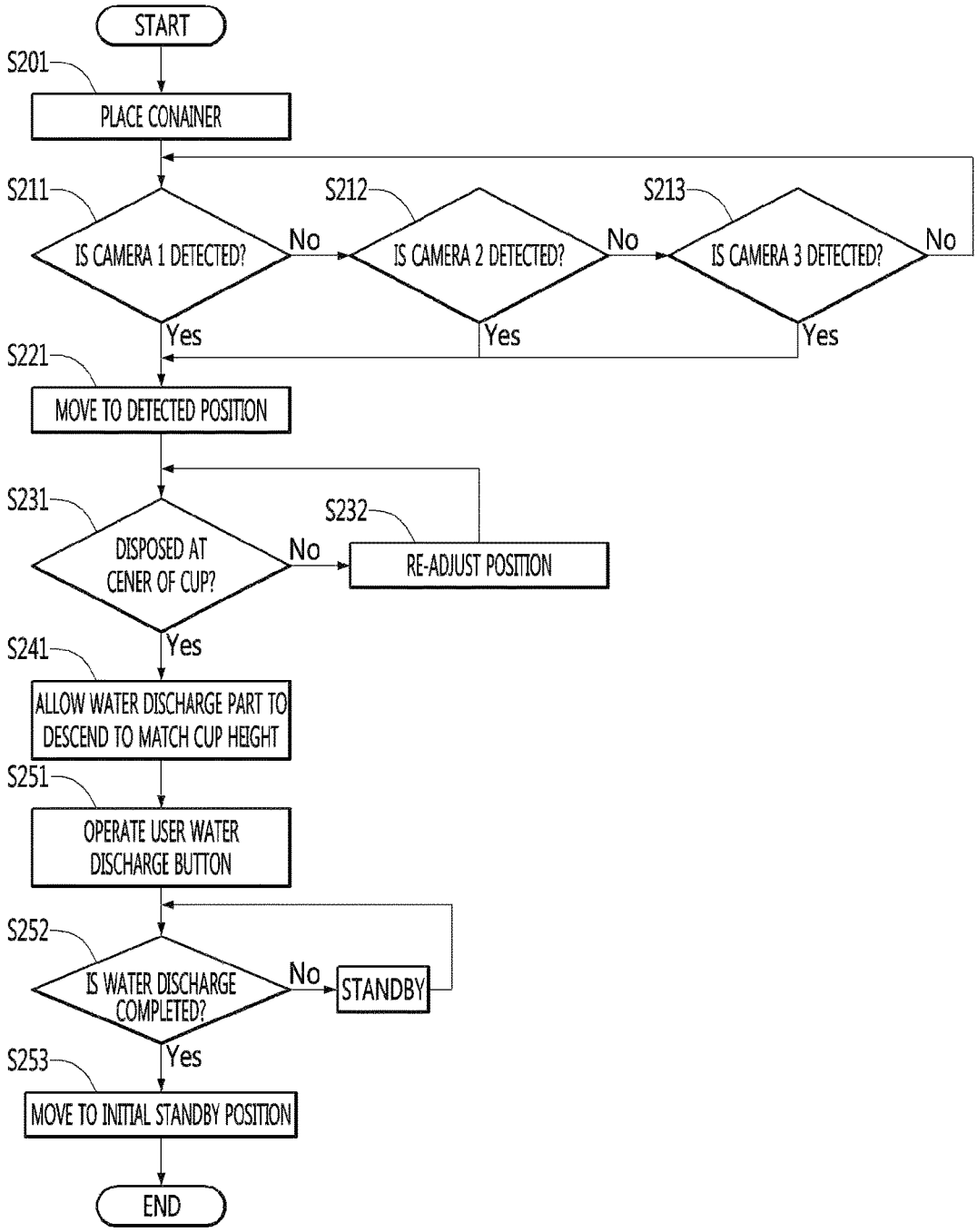
FIG. 14 is a flowchart illustrating a method for controlling a water purifier according to another embodiment.

FIG. 13 is a flowchart illustrating a method for controlling the water purifier according to an embodiment. FIG. 14 is a flowchart illustrating a method for controlling a water purifier according to another embodiment.

Hereinafter, a method for adjusting a height and position of the water discharge nozzle through control of the driving unit will be described.

For example, referring to FIGS. 5 and 13, when the detection unit 710 is provided as the proximity sensor, a method for controlling the water purifier will be described.

First, in a state in which power is supplied to the water purifier, a container is disposed around the water purifier body 100 by a user (S101).

Here, the 'container' may be an object such as a cup, a bottle, a pot, or the like having an opened upper portion and having an accommodation space in which water is contained according to various embodiments.

In the operation S101, the container is disposed at the front of the water purifier body 100. For example, the container is disposed around a front cover 111.

As described above, when the container is disposed around the front cover 111, the detection unit 710 detects a position and height of the container 710.

First, the detection unit 710 detects the position of the container.

Here, the detection unit 710 may be disposed in plurality along a circumference of the front cover 111.

Referring to FIG. 5, the position of the container is detected by the detection unit 710 disposed at the lowermost end. In this case, the position of the container may be detected regardless of the height of the container.

In detail, the container may be first detected by the proximity sensor 710 disposed at a left lower end in the drawing (S111).

In the operation S111, when the container is detected by the left proximity sensor 710, the control unit outputs a signal to the second driving member 620 so that the second driving member 620 and the second pinion gear 271 connected to the second driving member 620 rotate (S121).

Thus, the rotator 200 connected to the second pinion gear 271 and the water discharge module 400 may rotate to a left side, and the water discharge nozzle 430 may be disposed above the container.

On the other hand, in the operation S111, if the container is not detected by the left proximity sensor 710, the container is detected by the proximity sensor disposed at a center (S112).

In the operation S112, when the container is detected by the proximity sensor 710*b* disposed at the central portion, the control unit outputs a signal to the second driving member 620 so that the second driving member 620 and the second pinion gear 271 connected to the second driving member 620 rotate (S122).

Thus, the water discharge module 400 may rotate to the central portion, and the water discharge nozzle 430 may be disposed above the container.

If the water discharge module 400 is disposed at the central portion in a standby mode, the control unit may not output a separate signal to the second driving member 620, but the water discharge module 400 may be maintained in the state of being disposed at the central portion.

On the other hand, in the operation S112, if the container is not detected by the proximity sensor 710*b* disposed at the central portion, the container is detected by the proximity sensor disposed at the right side in the drawing (S113).

In the operation S113, if the container is detected by the right proximity sensor 710*c*, the control unit outputs a signal to the second driving member 620 so that the second driving member 620 and the second pinion gear 271 connected to the second driving member 620 rotate (S123).

Thus, the water discharge module 400 may rotate to the right side, and the water discharge nozzle 430 may be disposed above the container.

The rotator 200 and the water discharge module 400 may rotate according to the position of the container through the above-described method, and the water discharge nozzle 430 may be disposed above the container.

As described above, when the water discharge nozzle 430 is disposed above the container, the water discharge nozzle 430 may be adjusted in height according to the height of the container.

Hereinafter, a description will be given on the assumption that the container is disposed at the right side of the front cover 111.

First, the container may be detected by the proximity sensors 71-*d*, 710*e*, and 710*f* that are disposed to be spaced apart from each other in a longitudinal direction on the upper portion of the front cover 111 (S131).

In the operation S131, when the container is detected by all of the proximity sensors 710*d*, 710*e*, and 710*f*, the control unit outputs a signal to the first driving member 610 so that the first driving member 610 and the first pinion gear 450 connected to the first driving member 610 rotate.

Thus, the elevation cover 420 and the water discharge nozzle 430 may be disposed at the maximally ascending height.

Here, when the elevation cover 420 and the water discharge nozzle 430 are disposed at the maximally ascending height in the standby mode, the control unit may not output a separate signal, but the elevation cover 420 and the water discharge nozzle 430 may be maintained at the initial position (S141).

On the other hand, in operation S131, if the container is not detected by all of the proximity sensors 710*d*, 710*e*, and 710*f*, the container may be detected by the rest proximity sensors 710*e* and 710*f* except for the proximity sensor 710*d* disposed at the uppermost end (S132).

In the operation S112, when the container is detected by the rest proximity sensors 710*e* and 710*f* except for the proximity sensor 710*d* disposed at the uppermost end, the control unit outputs a signal to the first driving member 610 so that the first driving member 610 and the first pinion gear 450 connected to the first driving member 610 rotate by first revolution (S142).

Thus, the elevation cover 420 and the water discharge nozzle 430 may descend by a set height and then disposed around the upper end of the container disposed around the proximity sensor 710*e*.

On the other hand, in operation S132, if the container is not detected by the proximity sensors 710*e* and 710*f* except for the proximity sensor 710*d* disposed at the upper end, the container is detected by the proximity sensor 710*f* disposed at the lower end (S133).

In the operation S133, if the container is detected by the proximity sensor 710*f* disposed at the lower end, the control unit outputs a signal to the first driving member 610 so that the first driving member 610 and the first pinion gear 450 connected to the first driving member 610 rotate by second revolution greater than the first revolution (S143).

Thus, the elevation cover 420 and the water discharge nozzle 430 may descend by a set height and then disposed around the upper end of the container disposed around the proximity sensor 710*f*.

On the other hand, in the operation S133, if the container is not detected by all of the upper proximity sensors 710*d*, 710*e*, and 710*f*, the control unit determines that the container has a height that is lower than the proximity sensor 710*f* (S134).

Thus, the control unit outputs a signal to the first driving member 610 so that the first driving member 610 and the first pinion gear 450 connected to the first driving member 610 rotate by third revolution greater than the second revolution (S144).

Thus, the elevation cover 420 and the water discharge nozzle 430 may maximally descend by a set height and then disposed around the upper end of the container disposed below the proximity sensor 710*f*.

As described above, while the container is disposed around the front cover 111, the water discharge module 400 rotates according to the position and height of the container, and the elevation cover 420 and the water discharge nozzle 430 descend, when the water discharge nozzle 430 is disposed above the container, the user pushes a water discharge button (S151).

Thereafter, the control unit determines that dispensing of the purified water, the hot water, or the cold water is completed (S152).

Also, when the water dispensing is completed, the control unit controls the first driving member 610 and the second driving member 620 to allow the water discharge module 400 to return to its initial position (S153).

For another example, referring to FIGS. 6 and 14, when the detection unit 720 is provided as the camera, a method for controlling the position and height of the water discharge nozzle by controlling the driving unit will be described.

First, a container is disposed around the water purifier body 100 by a user (S201).

Here, the 'container' may be an object such as a cup, a bottle, a pot, or the like having an opened upper portion and having an accommodation space in which water is contained according to various embodiments.

In the operation S201, the container is disposed at the front of the water purifier body 100. For example, the container is disposed around a front cover 111.

As described above, when the container is disposed around the front cover 111, the detection unit 720 detects a position and height of the container 710.

First, the detection unit 720 detects a position of the container.

Here, the detection unit 720 may be disposed in plurality along a circumference of the front cover 111.

In detail, the container is detected by a camera 720*a* disposed at a left side in the drawing (S211).

Alternatively, the container may be detected by a camera 720*b* disposed at a central portion (S212).

Alternatively, the container may be detected by a camera 720*c* disposed at a right side in the drawing (S213).

Thereafter, the water discharge module 400 rotates to the positions of the cameras 720*a*, 720*b*, and 720*c*, at which the container is detected (S221).

In detail, in the operation S211, when the container is detected by left camera 720*a*, the control unit outputs a signal to the second driving member 620 so that the second driving member 620 and the second pinion gear 271 connected to the second driving member 620 rotate.

Thus, the rotator 200 and the water discharge module 400 may rotate to the left side, and the water discharge nozzle 430 may be disposed above the container.

In the operation S212, when the container is detected by the camera 720*b* disposed at the central portion, the control unit outputs a signal to the second driving member 620 so that the second driving member 620 and the second pinion gear 271 connected to the second driving member 620 rotate.

Thus, the water discharge module 400 may rotate to the central portion, and the water discharge nozzle 430 may be disposed above the container.

If the water discharge module 400 is disposed at the central portion in the standby mode, the control unit may not output a separate signal to the second driving member 620, but the water discharge module 400 may be maintained in the state of being disposed at the initially ascending or descending portion.

In the operation S213, when the container is detected by the right camera 720*c*, the control unit outputs a signal to the second driving member 620 so that the second driving member 620 and the second pinion gear 271 connected to the second driving member 620 rotate.

Thus, the water discharge module 400 may rotate to the right side, and the water discharge nozzle 430 may be disposed above the container.

The rotator 200 and the water discharge module 400 may rotate according to the position of the container through the above-described method, and the water discharge nozzle 430 may be disposed above the container.

The camera 720*d* that determines whether the water discharge nozzle 430 is disposed at the central portion of the container is installed on the lower end of the discharge nozzle 430 or the elevation cover 420 adjacent to the water discharge nozzle 430. The control unit determines whether the water discharge nozzle 430 is disposed at the center of the container through the camera 702*d* in the state in which the position of the water discharge nozzle 430 is automatically adjusted through the above-described processes (S231).

In the operation S231, if the water discharge nozzle 430 is not disposed at the center of the container, the rotator 200 and the water discharge module 400 may rotate until the water discharge nozzle 430 is disposed at the center of the container to adjust the position of the water discharge nozzle 430 again.

In the operation S231, it is determined that the water discharge nozzle 430 is disposed at the center of the container, the control unit may control the driving member 610 to adjust the height of the water discharge nozzle 430 according to the height of the container.

Here, the control unit may determine the height of the container on the basis of image information of the container, which is obtained by the cameras 720*a*, 720*b*, 720*c*, and 720*d*.

When the height of the container is determined as described above, the control unit outputs a signal to the first driving member 610 so that the first driving member 610 and the first pinion gear 450 connected to the first driving member 610 rotate (S241).

Thus, the elevation cover 420 and the water discharge nozzle 430 may descend by a set height and then disposed around the upper end of the container.

As described above, while the container is disposed around the front cover 111, the water discharge module 400 rotates according to the position and height of the container, and the elevation cover 420 and the water discharge nozzle 430 descend, when the water discharge nozzle 430 is disposed above the container, the user pushes a water discharge button (S251).

Thereafter, the control unit determines whether the dispensing of the water is completed (S252).

Also, when the dispensing of the water is completed, the water discharge module 400 may return to its initial position (S253).

In the foregoing embodiment, the position of the container is primarily detected by the detection units 710 and 720, and the control unit controls the driving unit 620 to allow the water discharge module 400 to rotate toward the container. Then, the height of the container is secondarily detected by the detection units 710 and 720, and the control unit controls the driving unit 610 to allow the water discharge module 400 to descend toward the container, but is not limited thereto.

As a modified example, the height of the container is primarily detected by the detection units 710 and 720, and the control unit controls the driving unit 610 to allow the water discharge module 400 to descend adjacent to the upper end of the container. Then, the position of the container is secondarily detected by the detection units 710 and 720, and the control unit controls the driving unit 620 to allow the water discharge module 400 to rotate toward the container.

Also, when the dispensing of the water from the water discharge nozzle 430 is completed, the control unit controls the driving units 610 and 620 to allow the water discharge module 400 to return its initial position, but is not limited thereto.

As a modified example, when the dispensing of the water from the water discharge nozzle 430 is completed, the water discharge nozzle 430 may not return to its initial position but be maintained in the state of rotating and descending to the position at which the water is dispensed.

Also, after the dispensing of the water from the water discharge nozzle 430 is completed, when the water discharge nozzle 430 returns to its initial position, the return position of the water discharge nozzle 430 may be variously changed.

Also, the detection unit 710 may be disposed on the lower end of the elevation cover 420. When a distance between the upper end of the container and the water discharge nozzle 430 reaches a preset safety distance while the first driving member 610 rotates, and the elevation cover 420 descends by the manipulation of the control unit, the control unit may adjust the height of the water discharge nozzle 430 in a manner of stopping the operation of the first driving member 610.

Also, in the foregoing embodiment, although the water discharge nozzle 430 is automatically adjusted in position through the detection unit, the control unit, and the driving unit without using the user's hand, the present disclosure is not limited thereto. In some cases, in a state in which the detection unit, the control unit, and the driving unit are turned off, the user may directly hold the water discharge module 400 to allow the water discharge module 400 to rotate in both directions, or the user may hold the elevation cover 420 to be elevated in the vertical direction and thereby manually adjusting the position of the water discharge nozzle 430. However, in this case, each of the rotation shafts of the first pinion gear and the second pinion gear may include an oil damper that provides rotation resistance force.

According to the foregoing embodiments, the water discharge nozzle may be freely changed in position and height in a state in which the water discharge nozzle is coupled to a main body of the water purifier in which the water discharge nozzle is provided. The water discharge module may automatically rotate or operate to be elevated so as to change a position of the water discharge nozzle. When the container such as the cup is placed around the water purifier by the user, the water purifier may detect the container so that the water discharge nozzle automatically rotates to the upper end adjacent to the container. The water discharge nozzle may descend according to the size of the container to dispense the water in the state in which the water discharge nozzle is automatically adjusted in height. The water may be discharged in the state in which the water discharge nozzle is adjusted in position, and when the water discharge is completed, the water discharge nozzle automatically may return to its original position.

Embodiments provide a water purifier in which a water discharge nozzle is freely changed in position and height in a state in which the water discharge nozzle is coupled to a main body of the water purifier in which the water discharge nozzle is provided.

Embodiments also provide a water purifier in which a water discharge module automatically rotates or operates to be elevated so as to change a position of the water discharge nozzle.

Embodiments also provide a water purifier in which, when a container such as a cup is placed around the water purifier by a user, the water purifier detects the container so that a water discharge nozzle automatically rotates to an upper end adjacent to the container.

Embodiments also provide a water purifier in which a water discharge nozzle descends according to a size of a container to dispense water in a state in which the water discharge nozzle is automatically adjusted in height.

Embodiments also provide a water purifier in which water is discharged in a state in which a water discharge nozzle is adjusted in position, and when the water discharge is completed, the water discharge nozzle automatically returns to its original position.

Embodiments also provide a water purifier that is capable of preventing water discharged from a water discharge nozzle from being splashed out of a cup by a head of the water dispensed from the water discharge nozzle.

Embodiments also provide a water purifier that is capable of changing a position of a water discharge nozzle according to various installation environments.

Embodiments also provide a water purifier in which a water discharge nozzle does not randomly drop down by a self-weight of an elevation cover in a state in which the elevation cover, on which a water discharge nozzle is mounted, is completely accommodated in a fixed cover, but be maintained in the state of being accommodated in the fixed cover.

Embodiments also provide a water purifier in which an elevation cover, on which a water discharge nozzle is mounted, is linearly elevated.

Embodiments also provide a water purifier in which deformation of a fixed cover and an elevation cover such as warpage is prevented, and mutual coupling force is secured.

Embodiments also provide a water purifier in which an elevation cover and a fixed cover are easily coupled to each other.

Embodiments also provide a water purifier in which an elevation cover, on which a water discharge nozzle is mounted, is smoothly elevated.

Embodiments also provide a water purifier which is capable of reducing abrasion and noises generated due to friction between an elevation cover and a fixed cover.

Embodiments also provide a water purifier in which various parts are not exposed to the outside to realize an elegant outer appearance.

Embodiments also provide a water purifier which is hygienic and capable of preventing a water discharge nozzle from being damaged and deformed.

In one embodiment, a water purifier includes: a water purifier body provided with a filter, purifying raw water supplied from the outside, and supplying purified water; a water discharge module of which at least a portion is coupled to protrude to the front of the water purifier body so that at least a portion thereof rotates or is elevated with respect to the water purifier body and which is provided with a water discharge nozzle, which supplies the purified water supplied from the water purifier body to a user, in a lower end thereof; a driving unit providing power providing power required for the rotation and elevation of the water discharge module; a detection unit installed in the water purifier body or the water discharge module to recognize a position and size of a container placed around the water purifier body; and a control unit receiving position information and size information of the container from the detection unit to control the driving unit so that the water discharge nozzle moves above the container.

The detection unit may be provided as a proximity sensor or a camera.

The detection unit may be disposed in plurality in a longitudinal direction on a front cover covering a front surface of the water purifier body or a side panel defining a side surface of the water purifier body.

The detection unit may be disposed in plurality in a transverse direction on a front cover covering a front surface of the water purifier body or a side panel defining a side surface of the water purifier body.

The front cover may have a shape that protrudes forward, and the detection unit may be disposed in plurality in a circumferential direction of the front cover.

The detection unit may be installed on a lower end of the water discharge module or the water discharge nozzle.

The outer discharge module may include: a rotator rotatably mounted inside the water purifier body to rotate with respect to the water purifier body; and an elevation unit fixed to the outside of the rotator to rotate together with the rotator so that the water discharge nozzle varies in height.

The elevation unit may include: a fixed cover fixed to the outside of the rotator, having an elevation space therein in a vertical direction, and opened downward; an elevation cover to which the water discharge nozzle is fixed and which is accommodated in the elevation space of the fixed cover to allow the water discharge nozzle to vary in height while being elevated; and a guide part guiding the elevation cover to be linearly elevated.

The guide part may include: a guide groove defined in the fixed cover along the elevation direction and having gear teeth therein; and a first pinion gear rotatably coupled to the elevation cover and inserted into the guide groove.

The driving unit may include a first driving member connected to a first rotation shaft of the first pinion gear to provide rotation power.

The control unit may change a rotation direction of the first driving member to elevate the elevation cover.

The water purifier body may include: a front cover having a shape that protrudes forward, having an opening, which is opened in a circumferential direction, in an upper portion thereof, and defining an outer appearance of a front surface of the water purifier body; a base defining a bottom surface of the water purifier body; a top plate defining a top surface of the water purifier body; and a filter bracket which is disposed at the rear of the front cover, of which an upper end is disposed at a height corresponding to the opening, and on which the filter is mounted, wherein the rotator may be rotatably mounted on an upper end of the filter bracket and covering the opening.

The front cover may include: a lower cover extending from the base up to a lower end of the opening to cover the filter bracket; and an upper cover spaced apart from the lower cover to extend from an upper end of the opening up to the top plate and rotatably coupled to an upper end of the rotator.

The filter bracket may include: a rotator mounting part having a curvature corresponding to an outer surface of the rotator and supporting a lower end of the rotator; a bottom part spaced downward from the rotator mounting part and mounted on the base; and a filter accommodation part connecting the rotator mounting part to the bottom part and providing a space in which the filter is accommodated.

A second pinion gear may be rotatably mounted on a lower end of the inside of the rotator, an internal gear may be disposed on the rotator mounting part in a circumferential direction, and when the rotator rotates, the second pinion gear may move along the internal gear.

The driving unit may include a second driving member connected to a second rotation shaft of the second pinion gear to provide rotation power.

The control unit may change a rotation direction of the second driving member to allow the rotator to rotate in both directions.

In another embodiment, a method for controlling the water purifier includes: disposing a container around the water purifier body by the user; detecting the position and height of the container by the detection unit; controlling the driving unit by the control unit so that the water discharge nozzle is disposed above the container; allowing the water discharge module to rotate or descend at an initial position by the operation of the driving unit so that the water discharge nozzle is disposed adjacent to an upper portion of the container; and performing dispensing of water from the water discharge nozzle.

The detection unit may primarily detect the position of the container, and the control unit may control the driving unit to allow the water discharge module to rotate to the container, and the detection unit may secondarily detect the height of the container, and the control unit may control the driving unit to allow the water discharge module to descend to the container.

When the dispensing of the water from the water discharge nozzle is completed, the control unit may control the driving unit to allow the water discharge module to return to its initial position.

According to the embodiment, the water discharge nozzle may be freely changed in position and height in a state in which the water discharge nozzle is coupled to a main body of the water purifier in which the water discharge nozzle is provided.

The water discharge module may automatically rotate or operate to be elevated so as to change a position of the water discharge nozzle.

When the container such as the cup is placed around the water purifier by the user, the water purifier may detect the container so that the water discharge nozzle automatically rotates to the upper end adjacent to the container.

The water discharge nozzle may descend according to the size of the container to dispense the water in the state in which the water discharge nozzle is automatically adjusted in height.

The water may be discharged in the state in which the water discharge nozzle is adjusted in position, and when the water discharge is completed, the water discharge nozzle automatically may return to its original position.

The water discharged from the water discharge nozzle may be prevented from being splashed out of the cup by the head of the water dispensed from the water discharge nozzle.

The water discharge nozzle may be changed in position according to the various installation environments.

The water discharge nozzle may not randomly drop down by the self-weight of the elevation cover in the state in which the elevation cover, on which the water discharge nozzle is mounted, is completely accommodated in the fixed cover, but be maintained in the state of being accommodated in the fixed cover.

The elevation cover, on which the water discharge nozzle is mounted, may be linearly elevated.

The deformation of the fixed cover and the elevation cover such as warpage may be prevented, and the mutual coupling force may be secured.

The elevation cover and the fixed cover may be easily coupled to each other.

The elevation cover, on which the water discharge nozzle is mounted, may be smoothly elevated.

The abrasion and noises generated due to the friction between the elevation cover and the fixed cover may be reduced.

The various parts may not be exposed to the outside to realize the elegant outer appearance.

The water purifier which is hygienic and capable of preventing the water discharge nozzle from being damaged and deformed may be provided.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid purifier comprising:

a liquid purifier body including a filter to purify a liquid;

a liquid discharge module, at least a portion thereof protruding at a front of the liquid purifier body and being at least one of rotated, raised, or lowered with respect to the liquid purifier body, and the liquid discharge module including, at a lower end thereof, a liquid discharge nozzle which supplies the purified liquid;

at least one driving motor that provides force to rotate, raise, and lower the liquid discharge module;

a sensor installed in at least one of the liquid purifier body or the liquid discharge module to detect at least one of a position or a size of a container placed around the liquid purifier body; and a controller to operate, based on the position or the size of the container, the driving motor to at least one of rotate, raise, or lower the liquid discharge nozzle, and wherein a plurality of the sensors that are provided in a transverse direction on at least one of a front cover covering a front surface of the liquid purifier body or a side panel defining a side surface of the liquid purifier body.

2. The liquid purifier according to claim 1, wherein the sensor includes at least one of a proximity sensor or a camera.

3. The liquid purifier according to claim 1, wherein the liquid purifier comprises a plurality of the sensors that are provided along a longitudinal direction on at least one of a front cover covering a front surface of the liquid purifier body or a side panel defining a side surface of the liquid purifier body.

4. The liquid purifier according to claim 1, wherein the front cover has a shape that protrudes forward, and the plurality of sensors are provided along a circumferential direction of the front cover.

5. The liquid purifier according to claim 1, wherein the sensor is installed on a lower end of the liquid discharge module or the liquid discharge nozzle.

6. The liquid purifier according to claim 1, wherein the liquid discharge module includes:

a rotator rotatably mounted inside the liquid purifier body to rotate with respect to the liquid purifier body; and an elevation unit fixed to the rotator to rotate together with the rotator and varying a height of the liquid discharge nozzle.

7. The liquid purifier according to claim 6, wherein the elevation unit includes:

a fixed cover that is fixed to the outside of the rotator, has an elevation space therein in a vertical direction, and is opened downward;

an elevation cover to which the liquid discharge nozzle is fixed and which is accommodated in the elevation space of the fixed cover to allow the liquid discharge nozzle to vary in height; and a guide guiding a vertical movement of the elevation cover.

8. The liquid purifier according to claim 7, wherein the guide includes:

a guide groove defined in the fixed cover along a vertical direction and having gear teeth therein; and a first pinion gear rotatably coupled to the elevation cover and inserted into the guide groove.

9. The liquid purifier according to claim 8, wherein the driving motor includes a first driving motor connected to a first rotation shaft of the first pinion gear to provide rotation power.

10. The liquid purifier according to claim 9, wherein the controller changes a rotation direction of the first driving motor to raise or lower the elevation cover.

11. The liquid purifier according to claim 6, wherein the liquid purifier body includes:

a front cover having a shape that protrudes forward, having an opening that extends in a circumferential direction in an upper portion thereof, and defining an outer appearance of a front surface of the liquid purifier body;

a base defining a bottom surface of the liquid purifier body;

a top plate defining a top surface of the liquid purifier body; and a filter bracket which is provided rear of the front cover, having an upper end disposed at a height corresponding to the opening, and on which the filter is mounted, wherein the rotator is rotatably mounted on the upper end of the filter bracket and covers the opening.

12. The liquid purifier according to claim 11, wherein the front cover includes:

a lower cover extending from the base up to a lower end of the opening to cover the filter bracket; and an upper cover spaced apart from the lower cover to extend from an upper end of the opening up to the top plate and rotatably coupled to an upper end of the rotator.

13. The liquid purifier according to claim 11, wherein the filter bracket includes:

a rotator mounting wall having a curvature corresponding to an outer surface of the rotator and supporting a lower end of the rotator;

a bottom wall spaced downward from the rotator mounting wall and mounted on the base; and a filter accommodation wall connecting the rotator mounting wall to the bottom wall and providing a space in which the filter is accommodated.

14. The liquid purifier according to claim 13, wherein a second pinion gear is rotatably mounted on a lower end of an inside of the rotator, an internal gear is provided on the rotator mounting wall in a circumferential direction, and when the rotator rotates, the second pinion gear moves along the internal gear.

15. The liquid purifier according to claim 14, wherein the driving motor includes a second driving motor connected to a second rotation shaft of the second pinion gear to provide rotation power.

16. The liquid purifier according to claim 15, wherein the controller manages a rotation direction of the second driving motor to cause the rotator to rotate in one or more directions.

17. A method for controlling a liquid dispenser including a body; a liquid discharge module that is movably provided on the body and includes a liquid discharge nozzle at a lower end thereof to supply liquid; a driving motor that provides force to cause the liquid discharge module to move relative to the body; a sensor to detect a container placed at the body; and a controller to manage the driving motor to provide the force to move the liquid discharge module, the method comprising:

operating the driving motor by the controller so that the liquid discharge module is at an initial position;

detecting, by the sensor, at least one of a position or a height of the container when the container is received at the body;

operating the driving motor to cause the liquid discharge module to rotate or descend from the initial position so that the liquid discharge nozzle is positioned adjacent to an upper portion of the container; and dispensing of liquid from the liquid discharge nozzle after the liquid discharge nozzle is positioned adjacent to the upper portion of the container, and wherein the sensor detects the position of the container when the container is received at the body, and the controller operates the driving motor to cause the liquid discharge module to rotate from the initial position to the container.

18. The method according to claim 17, wherein after the liquid discharge module rotates to the container, the sensor secondarily detects the height of the container, and the controller operates the driving motor to cause the liquid discharge module to descend to the container.

19. The method according to claim 17, wherein, when the dispensing of liquid from the liquid discharge nozzle is completed, the controller operates the driving motor to cause the liquid discharge module to return to the initial position.

* * * * *